US008509969B2

(12) United States Patent
Chen et al.

(10) Patent No.: US 8,509,969 B2
(45) Date of Patent: Aug. 13, 2013

(54) AUTOMATIC IDENTIFICATION METHOD AND SYSTEM FOR TRAIN INFORMATION

(75) Inventors: Zhiqiang Chen, Beijing (CN); Shangmin Sun, Beijing (CN); Xining Xu, Beijing (CN); Weizhi Lin, Beijing (CN); Yanwei Xu, Beijing (CN); Zhenbin Guo, Beijing (CN); Bin Hu, Beijing (CN); Guang Yang, Beijing (CN)

(73) Assignees: Nuctech Company Limited, Beijing (CN); Tsinghua University, Beijing (CN)

( * ) Notice: Subject to any disclaimer, the term of this patent is extended or adjusted under 35 U.S.C. 154(b) by 530 days.

(21) Appl. No.: 12/810,704

(22) PCT Filed: Dec. 26, 2008

(86) PCT No.: PCT/CN2008/002086

§ 371 (c)(1),
(2), (4) Date: Oct. 11, 2010

(87) PCT Pub. No.: WO2009/092200

PCT Pub. Date: Jul. 30, 2009

(65) Prior Publication Data

US 2011/0022253 A1 Jan. 27, 2011

(30) Foreign Application Priority Data

Dec. 27, 2007 (CN) ..... 2007 1 0304376

(51) Int. Cl.
*G05D 1/00* (2006.01)

(52) U.S. Cl.
USPC ..... 701/19

(58) Field of Classification Search
None
See application file for complete search history.

(56) References Cited

U.S. PATENT DOCUMENTS 3,721,820 A 3/1973 Caulier et al.
6,799,097 B2 9/2004 Villarreal Antelo et al.

(Continued)

FOREIGN PATENT DOCUMENTS

CN 1203161 12/1998
CN 1151045 5/2002

(Continued)

OTHER PUBLICATIONS

Zhang, Ning, et al., "Study of Identifying Railway Vehicle Based on Artificial Intelligence", Journal of the CHila Railway Society, 22:6, pp. 46-49, 2002.

(Continued)

*Primary Examiner* — Thomas Tarcza
*Assistant Examiner* — Adam Alharbi
(74) *Attorney, Agent, or Firm* — Morgan, Lewis & Bockius LLP

(57) ABSTRACT

The present invention relates to a method and system for automatically identifying various information of a train. The method comprises using sensors to collect wheelbase information, processing the information by signal data processing devices, thereby providing information of a train, namely: arranging a plurality of sensors along the rail in the incoming direction of the train, dividing the sensors into at least three groups, each group comprising at least two sensors; analyzing and processing the signal data stream obtained from the sensors and collected when a train vehicle passes by, thereby acquiring the speed and wheelbase of the train, and further acquiring the train segmentation information; determining the vehicle type; acquiring hook locating information; determining the train arrival; determining the train departure; acquiring vehicle number. The present invention further comprises a system for carrying out the information method for automatically identifying information of a train. The present invention can provide a plurality of types of train information with high accuracy, and is easy to be carried out.

45 Claims, 7 Drawing Sheets

(56) References Cited

U.S. PATENT DOCUMENTS

| | | | | |
|---|---|---|---|---|
| 6,840,587 | B2 * | 1/2005 | Eberle et al. | 303/131 |
| 7,068,186 | B2 * | 6/2006 | Hill et al. | 340/942 |
| 2002/0158507 | A1 * | 10/2002 | Eberle et al. | 303/113.1 |
| 2004/0061628 | A1 * | 4/2004 | Hill et al. | 340/942 |
| 2005/0173153 | A1 * | 8/2005 | Alft et al. | 175/46 |
| 2007/0240903 | A1 * | 10/2007 | Alft et al. | 175/50 |

FOREIGN PATENT DOCUMENTS

| | | | |
|---|---|---|---|
| CN | 1378934 | | 11/2002 |
| CN | 1164449 | | 9/2004 |
| CN | 2773661 | | 4/2006 |
| CN | 201102555 | | 8/2007 |
| DE | 100 64 598 | | 12/2000 |
| DE | 10064598 | C1 | 7/2002 |
| JP | 6-22401 | | 1/1994 |
| RU | 2 013 263 | C1 | 5/1994 |
| RU | 2 280 580 | C2 | 7/2006 |

OTHER PUBLICATIONS

Lui, Zhongdong, "Railway Automatic Train Identification System", Railway Computer Application, 14:7, pp. 1005-8451, 2005.

Mou, Ying et al., "Automatic Classification and Identification System for Vehicles Models", Microcomputer Applications, 27:4, pp. 471-473, 2006.

Russian Office Action dated Mar. 20, 2012 for corresponding Application No. 2010131032/11.

European Search Report dated Oct. 14, 2011 in application EP08871378.

* cited by examiner

AUTOMATIC IDENTIFICATION METHOD AND SYSTEM FOR TRAIN INFORMATION

TECHNICAL FIELD

The present invention relates to the field of automatic identification of information of passenger and goods trains.

BACKGROUND ART

In China, there are two patent documents that relate closely to the method and system for automatically identifying information of a train prescribed by the present invention. One is titled "EQUIPMENT FOR DISTINGUISHING PASSENGER TRAIN FROM GOODS TRAIN BY BETWEEN-CARRIAGE GAP COUNTING METHOD" (CN1164449C), which was granted the patent right on Sep. 1, 2004 under the application number of 02117867.4. The equipment for distinguishing passenger train from goods train by between-carriage gap counting method is characterized in that it uses two wheel passive magnetic sensors to determine the total length of the carriages to be analyzed, and dynamically detect the number of gaps between the carriages by using photoelectric sensors installed between them. Since the carriages of a passenger train are connected to each other and detecting light can not pass through them, the only pulse that can be produced originates from the gap between the locomotive and the first carriage. In contrast, there is a gap of approximately half a meter between two goods carriages. Therefore, within the total length of the carriages determined by the above two magnetic sensors, the train can be identified to be a goods train when number of the gap pulses is counted to be greater than or equal to a predefined threshold of the number of gaps, otherwise it is determined to be a passenger train. When the counting starts and ends is determined by a wheel arriving signal from the above two magnetic sensors.

The second patent document is titled "METHOD AND SYSTEM FOR DISTINGUISHING PASSENGER TRAIN FROM GOODS TRAIN BY BETWEEN-WHEEL SPACING METHOD" (CN1151045C), which was granted the patent right on May 26, 2004 under the application number of 02117863.1. The method and system for distinguishing passenger train from goods train by between-wheel spacing method comprises 4 magnetic sensors, and is based on the reality that the spacing between two groups of wheels of the passenger train is greater than that of goods train. Said 4 magnetic sensors are mounted at either rail on the side of the detection surface along the incoming direction of the drain, and comprises one pair of magnetic sensors for identifying the spacing between two wheels of which the distance between the centers is equal to that between the centers of a group of wheels, one magnetic sensor for shielding locomotive and generating a signal for beginning recognition, and another magnetic sensor for sensing arrival of locomotive, ending the recognition and reading the result. If the two magnetic sensors for identifying the spacing between two wheels respectively receive a wheel arrival pulse at the same instant, it can be determined that the train is a goods train, otherwise a passenger train.

Sometimes, in order to transport goods of large length, such as timber, two flat carriages need to be connected for use. In such a situation, the first method in the prior art for judging the passenger train or goods train will not be reliable. And besides, the photoelectric sensor is susceptible to influences from external environments such as sun light, rain, snow, and insects, and is prone to misoperation. As for the second method, it can be understood as following: if the wheelbase of a bogie is greater than a certain value, a passenger train is determined, and a goods train if smaller than a certain value. This method has a higher requirement for the positioning of the sensors, and is quite limited in train types. Besides, neither method can accurately provide the speed of a passing train, segmentation information, locating information or the like.

CONTENTS OF THE INVENTION

The purpose of the present invention is to provide an improved method and system for automatically identifying various information of a train, which provide various information of a passing train by measuring the speed and wheelbases of the train with wheel sensors mounted on the railway, and then performing real time analysis and process on the acquired speed and wheelbases. The purpose of the present invention comprises a method for providing information of train arrival and departure; a method for providing type information of a train; a method for providing hook locating information of a train; and a method for providing the numbering information of carriages of a train.

The technical solution of the present invention includes:

(1) A method for determining arrival and departure of a train, comprising:
   - i) arranging an array of sensors along one rail, the array comprising a first, a second and a third up sensor groups arranged in an order and a first, a second and a third down sensor groups arranged in an opposite order, wherein each of said groups comprise at least two sensors;
   - ii) calculating the speed and wheelbases of the train by using signal from the first up/down sensor group, and segmenting the calculated wheelbases by using known segmenting flow in a system database;
   - iii) determining the types of the respective carriages corresponding to the segmented wheelbases by using known carriage type distinguishing flow in the system database, and if a locomotive is distinguished and the number of wheelbases read continuously exceeds the maximum number of wheelbases of an known locomotive, it is determined that a train arrives; and
   - iv) monitoring the time intervals between the signal pulses of wheels provided by respective sensor groups, if the finish time of the signal pulses of any one sensor group has exceeded the extreme time interval determined by the maximum carriage wheelbase and a defined minimum train speed, it is determined that the signal of said sensor group has stopped, and if the signals of all sensor groups stop, it is determined that the train has departed.

(2) A method of providing type information of a segment of train, comprising:
   - i) arranging an array of sensors along one rail, the array comprising a first, a second and a third up sensor groups arranged in an order and a first, a second and a third down sensor groups arranged in an opposite order, wherein each of said groups comprise at least two sensors;
   - ii) calculating the speed and wheelbases of the train by using signal from the first up/down sensor group, and segmenting the calculated wheelbases by using known segmenting flow in a system database;
   - iii) determining the types of the carriages corresponding to the segmented wheelbases by using known carriage type distinguishing flow in the system database.

(3) A method of providing hook locating information of a train, comprising:

i) arranging an array of sensors along one rail, the array comprising a first, a second and a third up sensor groups arranged in an order and a first, a second and a third down sensor groups arranged in an opposite order, wherein each of said groups comprise at least two sensors;

ii) using a signal from the second up/third down sensor group (S2/X3) to calculate the speed and wheelbases of a train, and using known segmenting flow in a system database to segment the calculated wheelbases;

iii) in the case of a goods train, reading the time at which the second wheel of the second carriage of two successive carriages that have been segmented arrives at the position of the second up/third down sensor group, thereby providing hook locating information comprising a given amount of delay for use by an X-ray system;

iv) in the case of a passenger/goods train, reading the time at which the second wheel of the second carriage of two successive carriages that have been segmented arrives at the position of the third up/second down sensor group, thereby providing hook locating information comprising a set given amount of delay for use by a photograph system.

(4) A method of providing numbering information of a train, comprising:

i) arranging an array of sensors along one rail, the array comprising a first, a second and a third up sensor groups arranged in an order and a first, a second and a third down sensor groups arranged in an opposite order, wherein each of said groups comprise at least two sensors;

ii) using signal from the second up/third down sensor group to calculate the speed and wheelbases of the train, and segmenting the calculated wheelbases by using known segmenting flow in a system database;

iii) reading the carriage numbers from the electronic tags on the segmented carriages successively by the up/down carriage number reading device, and determining that the electronic tag being read the maximum times belongs to the carriage being running over the carriage number reading device.

(5) A method of providing identification information of a train, comprising:

i) arranging an array of sensors along one rail, the array comprising a first, a second and a third up sensor groups arranged in an order and a first, a second and a third down sensor groups arranged in an opposite order, wherein each of said groups comprise at least two sensors;

ii) in the signal from the first up/down sensor group, if the signal from former appears first, then it can be determined that there is a up train, otherwise there is a down train, and the signal from the first up/down sensor group is used to calculate the speed and wheelbases of the train, and a known segmenting flow in a system database is used to segment the wheelbases;

iii) using known type distinguishing flow in the database to determine the type of carriages corresponding to the segmented wheelbases, and if one carriage is determined to be locomotive and the number of wheelbases that are read successively exceeds the maximum number of wheelbases of a known locomotive, it is determined that an up/down-running train arrives, thereby providing first information on the arrival of an up/down-running train;

iv) successively determining the types of the two carriages behind said locomotive, and if at least one of them is a passenger carriage, it is determined that the train is a passenger train, otherwise a goods train, thereby providing second information on the arrived train being a passenger/goods train;

v) for a goods train, reading the time point at which the second wheel of the second one of two successive carriages arrives at the position of the second up/third down sensor groups, thereby providing third information on the train hook locating information that comprises a given amount of time delay and is for use by a X-ray scan system;

vi) reading the carriage numbers from the electronic tags on the segmented carriages successively by the up/down carriage number reading device, and determining that the electronic tag being read the maximum times belongs to the carriage being running over the carriage number reading device, thereby providing fourth information on the number of each carriage;

vii) for a passenger/goods train, reading the time point at which the second wheel of the second one of two segmented carriages arrives at the position of the second up/third down sensor groups, thereby providing fifth information on vehicle hook locating that comprises a given amount of time delay and is for use by a photograph system;

viii) monitoring the time intervals between the pulses of respective wheels from respective sensor groups, and if the finish time of the signal pulse from any one sensor group has exceeded the extreme time interval determined by the maximum wheelbase of a carriage and a defined minimum speed of the train, it is determined that the signal from said sensor group has stopped, and if signals from all sensor groups stop, a sixth information on the train's departure will be provided.

(6) A system for automatically identifying information of a train, comprising:

a sensor array arranged along the rail, comprising three up sensor groups arranged in an order and three down sensor groups arranged in an opposite order, each of said groups comprise at least two sensors;

a signal conditioning circuit box connected to the sensor array, comprising means for processing the signals from sensors into a sequence of regular pulse signal;

a data collecting card connected to the signal conditioning circuit box, comprising means for calculating the speed and wheelbases of a train from the signals of the sensors;

a carriage number reading device, comprising up and down carriage number reading means mounted between rails for reading information from the electronic tags on carriages of a train;

an industrial personal computer connected to the data collecting card and carriage number reading device, comprising means for executing steps ii)-viii) of the above method so as to process the speed, wheelbases and information from the electronic tags, thereby obtaining train information including an up/down-running train arrival, whether a passenger train or a goods train arrives, train hook locating, carriage number and train departure.

BENEFICIAL EFFECTS OF THE INVENTION

Compared with the between-carriage gap counting method in the prior art, the method and system for automatically identifying various information of a train according to the present invention are not affected by the carriage shape of the train and the goods carried by the train. Besides, the wheel sensor used by the present method and system is passive, so unlike the photoelectric sensor, which is influenced to a large extent by external environments such as sun light, the sensor of the present invention is basically not influenced by sun light, rain, snow and other external environment elements.

Compared with the between-wheel spacing method, the method and system of the present invention not only use the wheelbase of one axle of a carriage, but also collect the wheelbases of all wheels of a train and conduct comprehensive analysis on the same. Combining the database technology, the present method and system can distinguish passenger carriage, goods carriage and locomotive with very high accuracy under the condition of complying with the various basic rules for identification prescribed by the present invention. At the same time, it has eliminated the defect of the between-wheel spacing method in the prior art that has a strict requirement for the distance with which the sensors are installed.

In addition, the way for segmenting and locating used in this method are not disclosed by the above two prior art documents either. The present invention, in combination with a carriage number reading device, an X-ray inspection system or a photograph system, can be applied to such fields as goods train examining, railway informationization, and so on.

MODE OF CARRYING OUT THE INVENTION

The goods train Inspection system mentioned in this Specification is a fairly advanced X-ray inspection system for examining the goods in a goods train nowadays, which comprises a photograph system that acts as a subsystem of said inspection system. Said goods train inspection system, when in operation, uses firstly the accurate type information provided by the present invention according to its operation principle and requirement, namely it must determine the type of the train that is going to pass the inspection system in advance. When a passing train is a goods train, only after the locomotive of the train has completely passed the X-ray beam flux center of the inspection system, will the X-ray be activated to perform scanning. The operation of the inspection system further needs to be adjusted in real time according to the speed of the passing train. When every segment of the train (i.e. every carriage of the train) has passed the beam flux center, the system of the present invention will segment the scan image of the train according to segmenting and locating information, and, in the meantime, obtain the number of each carriage by reading the data provided by the carriage number reading device. Said information is important to the goods train inspection system.

Now the embodiments of the present invention are described with reference to the drawings.

Figure 1:
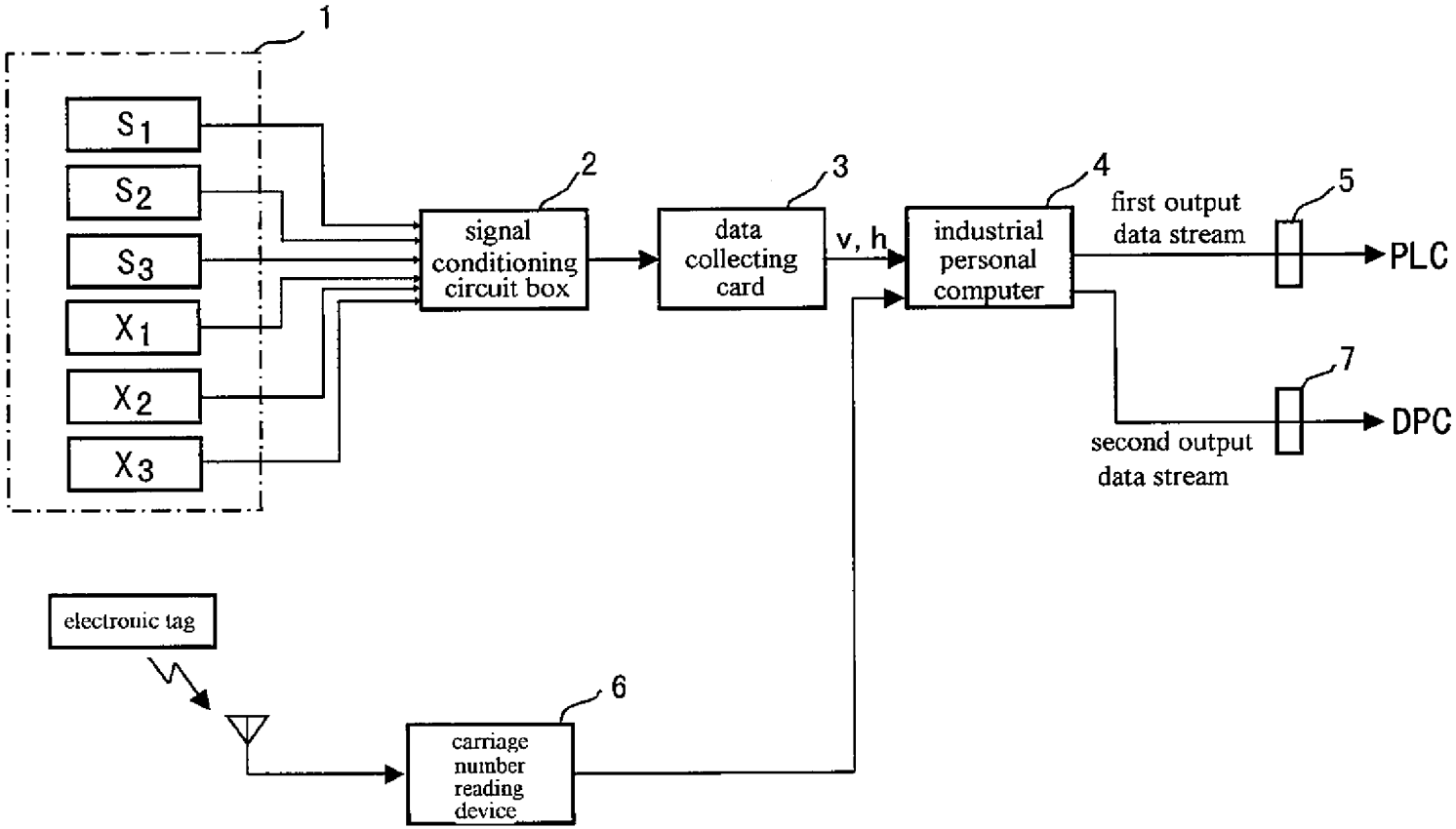
FIG. 1 is a block diagram showing the structure and principle of the system for automatic identification of a train according to the present invention.

FIG. 1 is a block diagram showing the structure and principle of the system for automatic identification of a train according to the present invention. In FIG. 1, the reference number 1 indicates a sensor array. The array is composed of a plurality of groups of sensors. Each of said groups comprises a certain number of sensors. According to the principle of the present invention, for example, six groups of sensors can be adopted, with each group being composed of three sensors. Alternatively, according to the principle of the present invention, the number of the group and the number of sensors in each group can be a different number. The principle for configuring the sensor array in the present invention can be understood with reference to the following description. In FIG. 1, there are furthermore a signal conditioning circuit box 2, a data collecting card 3, an industrial personal computer 4 (which receives the train speed v and wheelbase h calculated in the data collecting card 3), a serial port 5 for receiving a first output data stream from the industrial personal computer 4 and outputting it to PLC (programmable logic control unit of the train inspection system), a network port 7 for receiving a second output data stream from the industrial personal computer 4 and outputting it to DPC (data processing center of the train inspection system), and a carriage number reading device 6 for receiving, by the antenna shown in the figure, the signals transmitted by the electronic tags on the carriages of the train. These components will be described in detail below.

Figure 2:
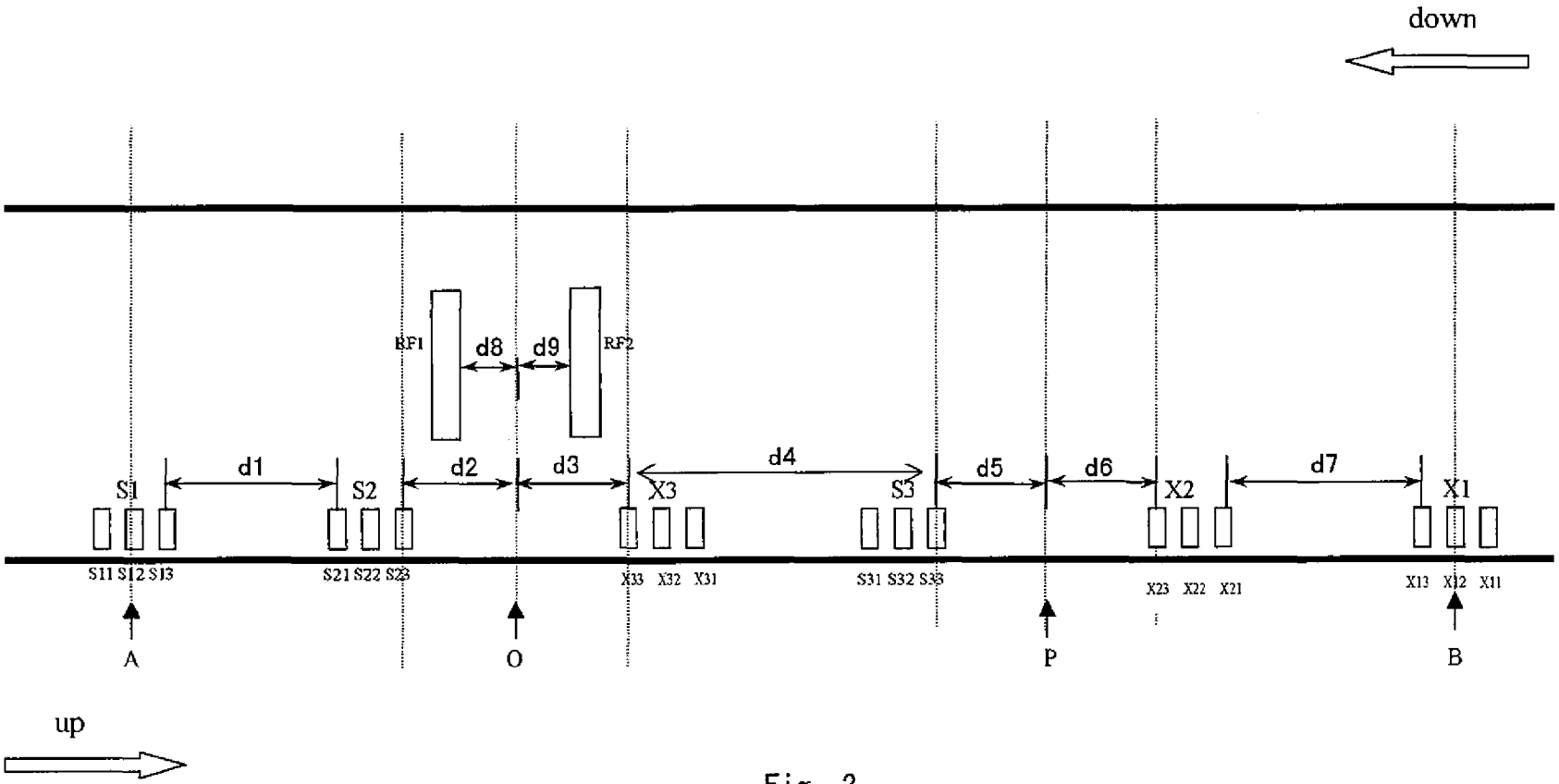
FIG. 2 is a schematic diagram illustrating the position for installing the sensor array and carriage number reading devices of the system of the present invention, this diagram at the same time illustrates the principle of a part of the operation procedure of the present invention.

The sensor array is mounted on one of the two sides of a rail which is close to the control room of the system, thus the wiring does not have to cross the rail. As shown in FIG. 2, three groups (S1, S2, S3, each group being composed of three sensors, in which two are operating sensors, one is a redundant sensor) in the six groups of sensors of the present invention are arranged on the inner side of a rail, for acquiring information generated by the wheels running in the direction from left to right (up), while the other three groups (X1, X2, X3) are also arranged inside the rail, for acquiring signals generated by a train running in the direction from right to left (down). In one group of sensors, e.g. group S1, the spacing between the respective sensors S11, S12, S13 is in the range of about 10-1,200 mm (determined by the minimum wheelbase of a goods carriage and the actual spacing between two railway sleepers). Because the X-ray source (O) of the system need a beam flux stabilizing period before starting to scan, the distances between the sensor group S1 and the X-ray source (O) as well as the sensor group X1 and X-ray source (O) shall not be less than the distance value calculated based on the maximum running speed of the train and the time for stabilizing the beam flux of the goods trains inspection system. For example, said value can be set to be d1=d7=3,000-700,000 mm in one embodiment. The distance d4 between a photograph system (P) and the X-ray source (O) is determined according to the actual situation in situ, wherein the photograph system P can be installed in any place between S1 and X1. The minimum values of the distance d2/d5 between the 2/3 up sensor groups (S2/S3) and X-ray source (O)/photograph system (P), and the distance d3/d6 between the 3/2 down sensor group (X3/X2) and X-ray source (O)/photograph system (P) are determined by the distance from the second axle of a goods carriage to its closest hook center. In the present invention, said distances are set to be d2=d3=d5=d6=3,000-4,500 mm, for example. Here the distance from the second axle of said goods carriage to its closest hook center, namely when the second axle of each carriage of the train running in the up direction arrives precisely at S2 and S3, between point O and point P is exactly the hook of two carriages, or when the second axle of each carriage of the train running in the down direction arrives precisely at X2 and X3, between point P and point O is exactly the hook of two carriages. Furthermore, as shown in FIG. 2, RF1 and RF2 are antennas of the carriage number reading device (the carriage number reading device is shown in the block 6 in FIG. 1) arranged on the ground between two rails for the up direction (namely the direction from left to right in the figure) and down direction (namely the direction from right to left in the figure) of the train respectively. The electronic tag on a carriage is usually mounted on the either end of the carriage. Up/down carriage number reading means are mounted symmetrically on the up/down sides of the X-ray source point O respectively, with the minimum value of the distance therebetween being determined so that not only interference can be decreased but also reading probability can be increased. In this invention, for example, the distances d8 between RF1 and point O and d9 between RF2 and point O are both set to be in the range of approximately 100-5,500 mm. In FIG. 2, O and P respectively represent the X-ray source and photograph system of the goods train inspection system mounted on site, while A and B respectively represent the positions for starting-up the inspection system with respect to up and down direction, namely the positions at which a determined starting-up signal that represents the arrival of a up/down-running train is transmitted.

FIG. 2 shows a case in which a train runs from left to right. Because the operating principle of the sensors is similar to a magnet, when every wheel of the locomotive and carriages of a train sequentially passes the sensor groups S1, S2, S3, the wheel cuts the magnetic force line of the sensor magnet. Said sensors then output voltage signals of which the amplitudes are different with respect to the different speeds of the train, thereby providing three sequences of sensor signals. Said sequences of sensor signals are sent via transmission lines to the signal conditioning circuit box 2, which is arranged in the machine cabinet of the train information automatic identification system of the present invention located adjacent to the sensor groups and perform proper processing on the signals of different amplitudes and waveforms.

Figure 3:
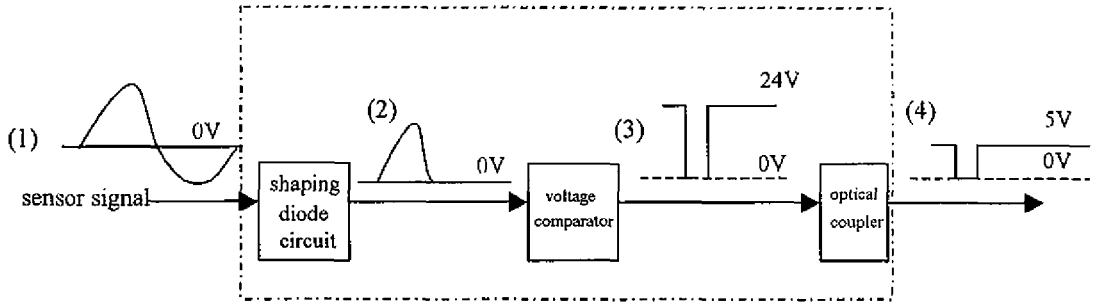
FIG. 3 is a schematic diagram illustrating the operating principle of the signal conditioning circuit box in the system of the present invention.

FIG. 3 is a schematic diagram showing the principle of the signal conditioning circuit box 2, where the sequences of the sensor signals are processed into sequences of regular pulse signals that can be used by data collecting card 3. When a train passes, the train wheels cut magnetic force line of a sensor, and a first voltage signal is produced. Said first voltage signal produced by the sensor is inputted into a shaping diode to filter the negative level portion in the signal and a second signal is obtained. The second signal is inputted into a voltage comparator, and a third signal is obtained after shaping. The third signal is inputted into an optical coupler, and an output signal is obtained after level converting.

Figure 4:
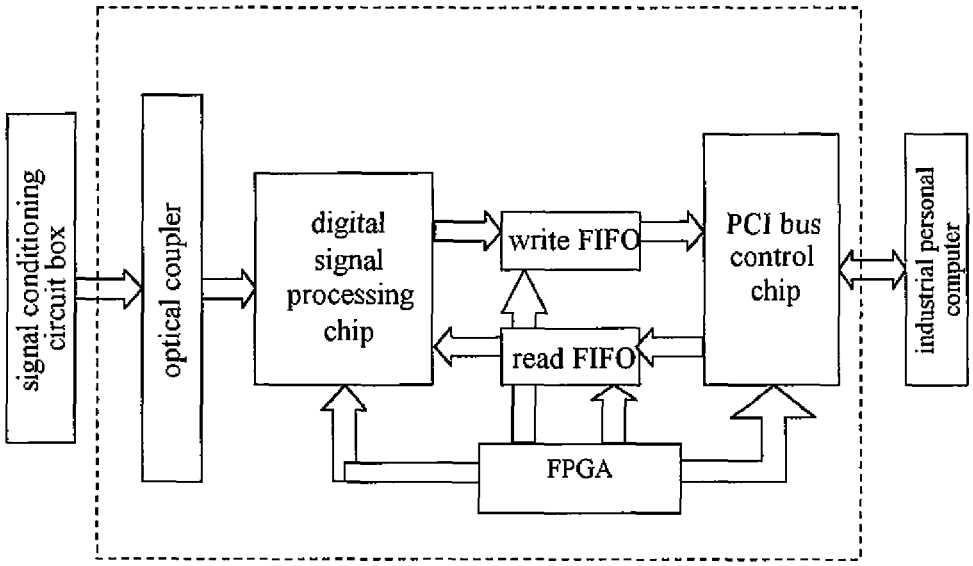
FIG. 4 is a schematic diagram illustrating the operating principle of the data collecting card in the system of the present invention.

The data collecting card 3 acquires the speed v and wheelbase h of a train in the manner prescribed by the present invention (which will be discussed in detail later) on the basis of the time of the arrival of the respective pulses in the inputted pulse signal sequences. The signals of a group of three sensors, after passing through the sensor conditioning circuit box, become sequences of regular pulse signals and are inputted into the data collecting card. As shown in FIG. 4, the pulse signal sequences are inputted into a digital signal processing DSP chip via an optical coupler and processed by the DSP, which calculates the speed and wheelbase, uses one word to indicate the speed and wheelbase thus obtained respectively, and adds a header of one word and a tail of one word to the one word indicating the speed and the one word indicating the wheelbase respectively so as to form two packets to store in a write FIFO. The industrial personal computer reads the speed and wheelbase from the write FIFO via a PCI bus. The distances with which the sensors are installed used in calculating the speed and wheelbase are written by the industrial personal computer into the read FIFO via a PCI bus and read by DSP from the read FIFO when the system starts up. All logic control of data transmission is achieved by CPLD. The optical coupler, for example, is a M601 chip; the DSP, for example, is TMS320F2812; the CPLD, for example, is EMP7128; the FIFO, for example, is IDT7203; and the PCI bus control chip is, for example, PCI9052 of PLX. The above components are all general purpose electronic units. PCI is the abbreviation of Peripheral Component Interconnect, which is an interface most widely used in personal computers nowadays, and almost all mainboard products have such slots. CPLD is the abbreviation of Complex Programmable Logic Device, and users can reconfigure the logic module and I/O module inside the CPLD to achieve their logic control. The read/write FIFO refers to First Input First Output data memory chip and has a certain memory spacing, and the data written into the chip first will be read out first when reading. The PCI collecting card is provided with two FIFO chips thereon. The chip written by DSP and read by industrial personal computer is referred to as write FIFO whereas the chip read by DSP and written by industrial personal computer is referred to as read FIFO. The function of the optical coupler is to achieve insulation between electrical and optical signals, namely optical coupling is adopted when inputting and outputting signals, which performs the function of electrical insulation. Next, the data stream processed by the data collecting data 3 and comprising speed v and wheelbase h is outputted to the industrial personal computer 4.

The industrial personal computer 4, on the basis of the speed v and wheelbase h in the received data stream, analyzes and processes the information about wheelbase in the manner prescribed by the present invention (as will be detailed in the following), and then obtains the following information respectively: carriage type, train segmentation, hook locating, train arrival, train departure, carriage number and so on. The industrial personal computer 4 outputs, via a serial port 5, the first output data stream comprising said information/data as well as the abovementioned speed and wheelbase to said goods train inspection system, or to be more specific, to the programmable logic controller of the system, namely the PLC or other processors in FIG. 1.

In addition, it can be seen from FIG. 1 that the system of the present invention further comprises a carriage number reading device 6 having an electronic tag reading antenna. The electronic tag reading antenna is mounted on the inner side of a rail, suitable for reading successively in a wireless manner the electronic tag signal transmitted by the electronic tag mounted at the bottom of each carriage. The technology adopted here is consistent with the technology of a common electronic card reader receiving information from a chip card sweeping through the detection area of the card reader, so will not be elaborated upon. The electronic tag signal received by the antenna from the electronic tag is sent to the carriage number reading device 6 of the system, where the signal is processed into a real time data stream suitable for use by the industrial personal computer 4.

After the real time data stream is sent to the industrial personal computer 4, it is further processed therein and forms a file comprising carriage numbering information. The file is comprised in the second output data stream of the industrial personal computer. The second output data stream is provided via a network port 7 to the above train inspection system, or to be more specific, to the data processing center of the system, namely the DPC in FIG. 1.

Figure 5:
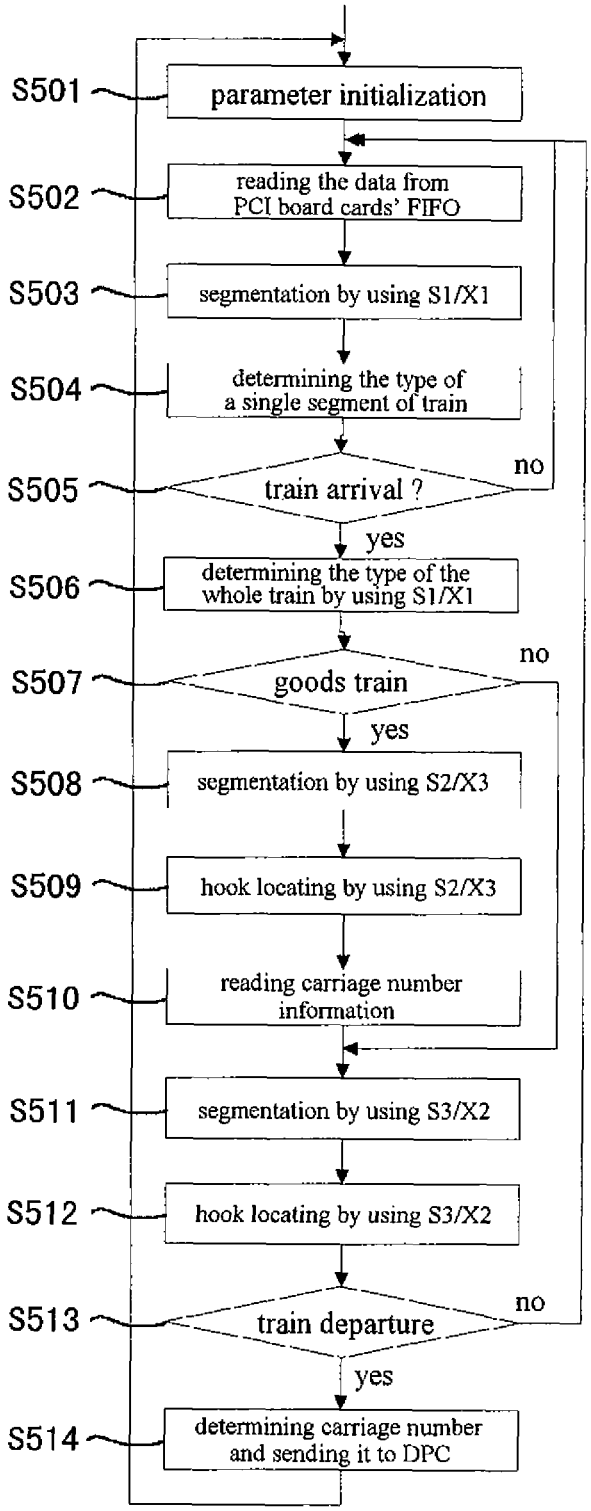
FIG. 5 is a schematic diagram illustrating the train information automatic identification flow carried out by the industrial personal computer in the system of the present invention.

FIG. 5 is a schematic diagram illustrating the entire process of the automatic identification of train information carried out by the industrial personal computer. Every block in FIG. 5 is specifically explained as follows:

S501: initializing the system so as to initializes the parameters used in the subsequent flow. For example, how many wheelbases have been read from the PCI board card currently, what are the specific values of the wheelbases and so on.

S502: Reading data successively from the FIFOs of the six PCI board cards corresponding to the six groups of sensors, and deriving the wheelbases and speed.

S503: If the board card to which S1 corresponds has data of speed and wheelbase before the board card to which X1 corresponds, it means that the running direction of the train is up, then segmenting the wheelbases data from the board card to which S1 corresponds; otherwise, the running direction of the train is down, and segmenting the wheelbases in the board card to which X1 corresponds.

S504: In the case of an up-running train, judging the type of a single segment of the train after segmentation has been performed by using S1; and in the case of a down-running train, judging the type of a single segment of the train after segmentation has been performed by using X1.

S505: In the case of an up-running train, if the number of wheelbase data read from the board card to which S1 corresponds is greater than 12, and one among the segments of the train obtained after segmenting the wheelbases in S1 is a locomotive, then it can be determined that a train arrives and the train arrival information is sent by the serial port. If a train arrives, the process goes into the next step. If no train arrives, the PCI board card is continued to be read. The same applies to a down-running train, and the board card to which X1 corresponds is processed.

S506: In the case of an up-running train, the type of a single segment of the train is used to determine the type of the whole train. Concretely, if the two segments behind the locomotive are both goods carriages, the whole train is determined to be a goods train. And if one of said two segments is a passenger carriage, the whole train is determined to be a passenger train for the sake of safety.

S507: After determining the type of the train, the type information is sent via the serial port to notify the PLC. If the train is a goods train, the X-ray inspection system and the photograph system are started. Then the wheelbase data detected by S2 is segmented, and when a hook arrives at point O is determined. In the case of a passenger train, only the photograph system is started, the wheelbase data detected by S3 are segmented, and when a hook arrives at point P is determined.

S508: In the case of an up-running train, the wheelbase data read by the board card to which S2 corresponds are segmented. And in the case of a down-running train, the wheelbase data read by the board card to which X3 corresponds are segmented.

S509: In the case of an up-running train, when a hook of the train arrives at point O is determined by using the wheelbase data from S2. And in the case of a down-running train, when a hook of the train arrives at point O is determined by using the wheelbase data from X3. The information about the hook thus determined is sent to PLC via a serial port.

S510: In the case of an up-running train, numbering information of the train is read from the serial port connected to the carriage number reading device having the antenna RF1, and which segment of the train is passing point O when reading said numbering information is recorded. In the case of a down-running train, numbering information of the train is read from the serial port connected to the carriage number reading device having the antenna RF2.

S511: In the case of an up-running train, the wheelbase data read by the board card to which S3 corresponds are segmented; and in the case of a down-running train, the wheelbase data read by the board card to which X2 corresponds are segmented;

S512: In the case of an up-running train, when a hook of the train arrives at point P is determined by using wheelbase data from X3. In the case of a down-running train, when a hook of the train arrives at point P is determined by using the wheelbase data from X3. The information about the hook thus determined is sent to PLC via a serial port.

S513: If all six board cards have provided information indicating that the train has departed from the sensors that said board cards correspond respectively, then it should be concluded that the train has departed. If the train has departed, the process goes into the next step. Otherwise the PCI board card is continued to be read.

S514: If the train has departed, the carriage to which the read number corresponds is determined and written into a text file to be sent via FTP to the data processing center (DPC). The whole process ends, and a re-initialization is performed.

(1) The Acquisition of Speed and Wheelbase

The calculation of speed and wheelbase is completed in a PCI board card. Each group of three sensors corresponds to one PCI board card through the signal conditioning box. Therefore, when a train passes, three board cards to which three sensor groups correspond in one direction will generate three sets of the wheelbase and speed of the train. As the three sensor groups are mounted in different positions and the speed can be calculated only when the train wheels run over the sensors, the three speeds may be the speeds of the train at different moments. The industrial personal computer takes a speed value acquired most recently as the speed of the train. The wheelbase values from S1/X1 are used for determining the arrival and type of a train, while other wheelbase values are used for locating the hook of the train at corresponding positions.

In operation, principle of the train information identification system according to the present invention is: the distance between the two axles of a passenger train (including not only the wheelbase of bogie, but also the distance between bogies) is different obviously from the distance between the two axles of a goods train. If a carriage can not be identified by the identification operation of the identification system, it will be taken as a passenger train for the sake of safety, so as to prevent X-ray examination and misoperation that may result in radioactive incidents.

Figure 6:
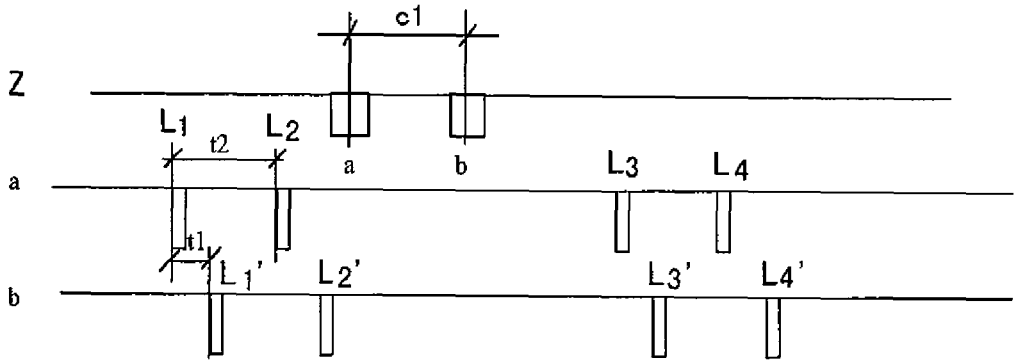
FIG. 6 is a schematic diagram illustrating the principle of the calculation of the train speed and wheelbases by the system of the present invention.

The principle of calculating the speed and wheelbases is shown in FIG. 6. Any two of three sensors in every sensor group can be used for calculating the speed and wheelbases of a train, while the other sensor for redundancy and backup, so that when one sensor loses its signal, the speed and wheelbases of the train can still be measured accurately.

In FIG. 6, axis Z represents one rail on which only two operating sensors a and b in a certain sensor group (which is composed of three sensors) in the sensor array of the present invention are shown, while c1 is the distance between sensors a and b, for example, 10-1,200 mm, the value of which is determined based on the actual spacing between two railway sleepers and the minimum wheelbase of a goods carriage. The second and third axes in FIG. 6, namely axes a and b, illustrate respectively the timing chart of the wheel pulse signals collected by the system of the present invention after one carriage (usually one carriage has, e.g. four axles) passes sensors a and b. To be more specific, four wheel pulse signals $L_1$, $L_2$, $L_3$, $L_4$ generated by the sensor a are illustrated on the axis a, and four similar wheel pulse signals $L_{1'}$, $L_{2'}$, $L_{3'}$, $L_{4'}$ generated by the sensor b are illustrated on the axis b.

In FIG. 6, the time difference between the first pulses on axis a and b corresponds to a known distance (e.g. the distance c1 between two adjacent sensors) on the rails that a train has passed. If the time for a wheel to pass the distance c1 is assumed to be t1, it is obvious that the speed of the train can be calculated with the following physical formula:

$$v=c1/t1 \qquad \text{formula 1}$$

The wheelbase is calculated by using the following formula:

$$\text{wheelbase } h=\frac{v1+v2}{2}\cdot t2 \qquad \text{formula 2}$$

wherein v1 is the arriving speed of the previous wheel, v2 is the arriving speed of the current wheel, t2 is the time interval for said two wheels to pass the same sensor on the rail.

(2) The Segmentation of a Train

Figure 7:
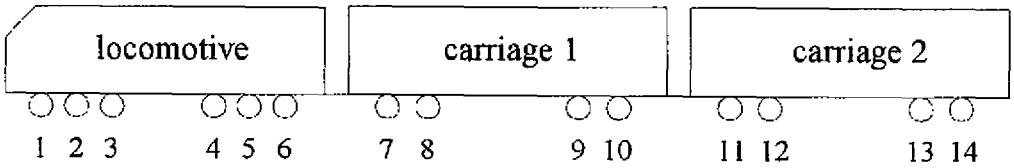
FIG. 7 is a schematic diagram illustrating the principle of the train segmenting process of the system of the present invention.

In the system of the present invention, the so-referred to as "segmentation" means to divide, or segment, a series of collected wheelbase data of a train so as to correspond the real carriage segments. At present, most domestic train carriages have 4, 5, 6 or 8 axles and their wheelbases satisfy three laws as following: (1) the wheelbases are symmetrical about the central point of a carriage, as shown in FIG. 7, the locomotive has $L_{1,2}=L_{5,6}$, $L_{2,3}=L_{4,5}$, and the carriage 1 has $L_{7,8}=L_{9,10}$ (wherein $L_{ij}$ indicates the distance between the $i^{th}$ wheel and the $j^{th}$ wheel); (2) the distance from the first wheel to the last wheel of a carriage is larger than 7 m, as shown in FIG. 7, that is, for the locomotive, $L_{1,6}>7$ m, and for the carriage 1, $L_{7,10}>7$ m; and (3): the wheelbase between two bogies is greater than the wheelbase at the hook, and the wheelbase at the hook is greater than the wheelbase of a bogie, for example, as shown in the figure, the locomotive has $L_{3,4}>L_{6,7}>L_{1,2}$, the carriage 1 has $L_{8,9}>L_{10,11}>L_{7,8}$. In addition, there are certainly carriages having wheelbases of which the number is equal to other positive integers, and the laws that said wheelbases satisfy can be easily obtained through analysis according to the principle of the present invention so as to be incorporated into the above known laws to be used together.

Figure 8:
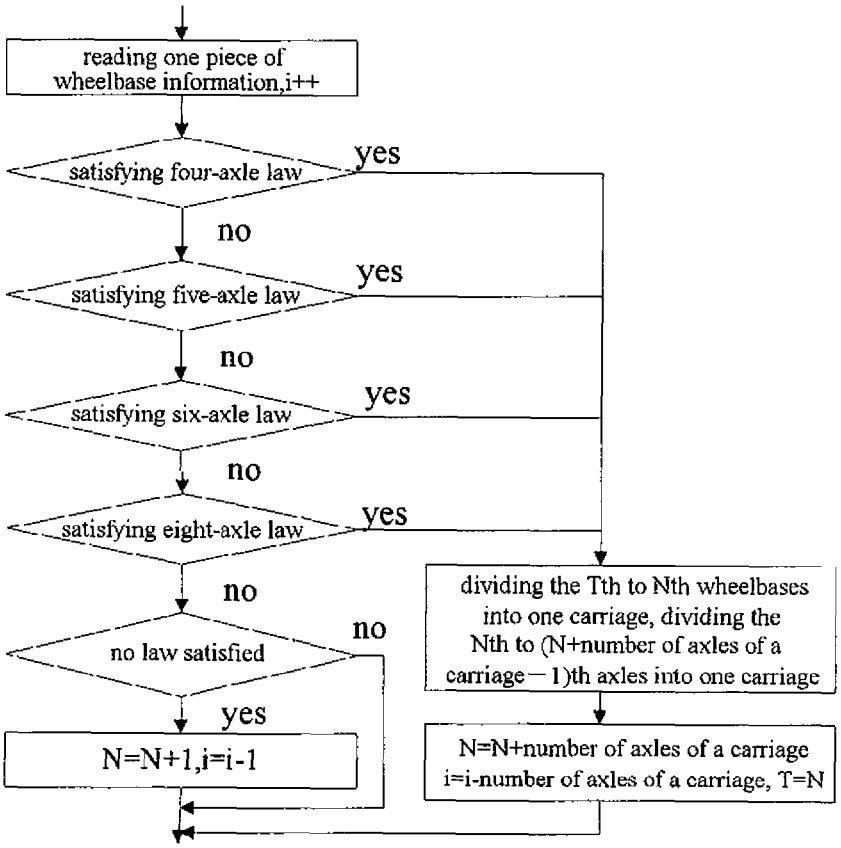
FIG. 8 is an illustrative flow diagram showing the train segmenting process of the system of the present invention.

The method for segmenting wheelbases of a train is shown by the flow chart of FIG. 8.

System initialization: This step is implemented in the "parameter initialization" shown in FIG. 5. T and N are set to 1, and i is set to 0. T represents that the wheelbases before the $T^{th}$ wheelbase have been divided so as to correspond to individual carriages; N represents that the $N^{th}$ wheelbase is being used currently to segment the train; and i represents the current number of wheelbases that have not been used for segmentation.

Reading one piece of wheelbase information: This step is implemented in the "reading the data in PCI board card FIFO" shown in FIG. 5. When two wheels of one train pass a group of sensors, the PCI data collecting card connected to the group of sensors immediately calculates a piece of wheelbase information, and stores it in the FIFO of the collecting card. At this moment, the identification system in the industrial personal computer can read this piece of wheelbase information via the PCI bus, and accordingly the number i of the wheelbases that can be used for segmentation increases by 1.

Applying a four-axle law: Applying the three laws of the wheelbase to four axles carriage, results the following four laws that a four-axle carriage must satisfy:

Law 1: The $N^{th}$ wheelbase value is approximately equal to the $N+2^{th}$ wheelbase value, i.e. the absolute value of the difference between the $N^{th}$ wheelbase value and the $N+2^{th}$ wheelbase value is less than 100 mm;

Law 2: The sum of the $N^{th}$, $N+1^{th}$ and $N+2^{th}$ wheelbases is greater than 7,000 mm;

Law 3: The $N+1^{th}$ wheelbase value is greater than the $N+3^{th}$ wheelbase value;

Law 4: The $N+3^{th}$ wheelbase value is greater than the $N^{th}$ wheelbase value.

When $i\leqq 2$, namely the number of wheelbases that have not been used for segmentation currently is less than 3, no four-axle law analysis is carried out due to insufficient data for analysis.

When i=3, namely the number of wheelbases that have not been used for segmentation currently is equal to 3, analysis can be carried out for such three wheelbases from $N^{th}$ to $N+3^{th}$ with respect to Law 1 and Law 2. If Law 1 and Law 2 are not satisfied, it will be deemed that current segmentation does not satisfy the four-axle law; if satisfied, it will be deemed that current segmentation may satisfy the four-axle law, then waiting for the next axle, namely i=4.

When $i\geqq 4$, namely the number of wheelbases that have not been used for segmentation currently is greater than 3, whether such four wheelbases from $N^{th}$ to $N+3^{th}$ satisfy the four laws stated above is checked. If said four laws are satisfied, it will be deemed that the four-axle law is satisfied; if not satisfied, it will be deemed that the four-axle law is not satisfied.

A five-axle law: Similar to the four-axle law, applying three laws of the wheelbase to five axles results the following five laws that a five-axle carriage must satisfy:

Law 1: The $N^{th}$ wheelbase value is approximately equal to the $N+3^{th}$ wheelbase value, i.e. the absolute value of the difference between the $N^{th}$ wheelbase value and the $N+3^{th}$ wheelbase value is less than 100 mm;

Law 2: The $N+1^{th}$ wheelbase value is approximately equal to the $N+2^{th}$ wheelbase value, i.e. the absolute value of the difference between the $N+1^{th}$ wheelbase value and the $N+2^{th}$ wheelbase value is less than 100 mm;

Law 3: The sum of the $N^{th}$, $N+1^{th}$, $N+2^{th}$ and $N+3^{th}$ wheelbases is greater than 7,000 mm;

Law 4: The $N+1^{th}$ wheelbase value is greater than the $N+4^{th}$ wheelbase value;

Law 5: The $N+4^{th}$ wheelbase value is greater than the $N^{th}$ wheelbase value.

When $i\leqq 3$, no five-axle law analysis is carried out due to insufficient data for analysis. When i=4, analysis on Law 1, Law 2 and Law 3 can be conducted. When $i\geqq 5$, the five-axle law analysis is carried out, and if said five laws are satisfied, it will be deemed that the five-axle law is satisfied, otherwise it will be deemed that the five-axle law is not satisfied.

A six-axle law: Similar to the four-axle law, applying the three laws of the wheelbase to six axles results the following five laws that a six-axle carriage must satisfy:

Law 1: The $N^{th}$ wheelbase value is approximately equal to the $N+4^{th}$ wheelbase value, i.e. the absolute value of the difference between the $N^{th}$ wheelbase value and the $N+4^{th}$ wheelbase value is less than 100 mm;

Law 2: The $N+1^{th}$ wheelbase value is approximately equal to the $N+3^{th}$ wheelbase value, i.e. the absolute value of the difference between the $N+1^{th}$ wheelbase value and the $N+3^{th}$ wheelbase value is less than 100 mm;

Law 3: The sum of the five wheelbases of $N^{th}$ to the $N+4^{th}$ is greater than 7,000 mm;

Law 4: The $N+2^{th}$ wheelbase value is greater than the $N+5^{th}$ wheelbase value;

Law 5: The $N+5^{th}$ wheelbase value is greater than the $N^{th}$ wheelbase value.

When $i \leqq 3$, no six-axle law analysis is carried out due to insufficient data for analysis. When $i=4$, analysis on Law 2 can be conducted. When $i=5$, analysis on Laws 1, 2, 3, 4 can be conducted. When $i \geqq 6$, analysis can be carried out with respect to the five laws; and if satisfied, it will be deemed that the six-axle law is satisfied, otherwise it will be deemed that the six-axle law is not satisfied.

An eight-axle law: Similar to the four-axle law, applying the three laws of the wheelbase to eight axles results the following six laws that an eight-axle carriage must satisfy:

Law 1: The $N^{th}$ wheelbase value is approximately equal to the $N+6^{th}$ wheelbase value, i.e. the absolute value of the difference between the $N^{th}$ wheelbase value and the $N+6^{th}$ wheelbase value is less than 100 mm;

Law 2: The $N+1^{th}$ wheelbase value is approximately equal to the $N+5^{th}$ wheelbase value, i.e. the absolute value of the difference between the $N+1^{th}$ wheelbase value and the $N+5^{th}$ wheelbase value is less than 100 mm;

Law 3: The $N+2^{th}$ wheelbase value is approximately equal to the $N+4^{th}$ wheelbase value, i.e. the absolute value of the difference between the $N+2^{th}$ wheelbase value and the $N+4^{th}$ wheelbase value is less than 100 mm;

Law 4: The sum of the seven wheelbases of $N^{th}$ to the $N+6^{th}$ is greater than 7,000 mm;

Law 5: The $N+3^{th}$ wheelbase value is greater than the $N+7^{th}$ wheelbase value;

Law 6: The $N+7^{th}$ wheelbase value is greater than the $N^{th}$ wheelbase value.

When $i \leqq 4$, no eight-axle law analysis is carried out due to insufficient data for analysis. When $i=5$, analysis on Law 3 can be conducted. When $i=6$, analysis on Laws 2, 3 can be conducted. When $i=7$, analysis on Laws 1, 2, 3, 4 can be conducted. When $i \geqq 8$, analysis can be carried out with respect to the six laws; and if satisfied, it will be deemed that the eight-axle law is satisfied, otherwise it will be deemed that the eight-axle law is not satisfied.

If none of the laws is satisfied, namely, none of the four-, five-, six- and eight-axle laws is satisfied, then $N=N+1$, and $i=i-1$. $N=N+1$, indicates that segmentation is started from the $N+1^{th}$ axle next time; and $i=i-1$ indicates that the number of the wheelbases that have not been used for segmentation decreases by 1. In other words, the $N^{th}$ axle cannot be used for segmentation and thus put aside temporarily, with T being not equal to N at this point. Analysis will be resumed with respect to the four-, five-, six- and eight-axle law when a next process starts.

The $T^{th}$ to $N^{th}$ wheelbases are segmented as one carriage of the train. If any of the four-, five-, six- and eight-axle law is satisfied, then it can be determined that the current wheelbase values are the wheelbase values of one carriage of the train and the number of axle of said carriage of the train can also be determined. The $N^{th}$ to $(N+\text{axle number of one carriage}-1)^{th}$ axles are segmented as one carriage. For example, if the four-axle law is satisfied, then the $N^{th}$, $N+1^{th}$, $N+2^{th}$ and $N+3^{th}$ wheelbase values are the four wheelbase values of one four-axle carriage, and the axle number of the carriage is 4.

The $T^{th}$ axle to the $N^{th}$ axle are segmented as one carriage. If $T=N$, namely there are no wheelbase values that can not be used for segmentation before, then this step will not be carried out. If $T \geqq N$, namely there are wheelbase values that can not be used for segmentation before, then all the previously wheelbase values that are not used for segmentation are segmented as one carriage, that is, the $T^{th}$ wheelbase to the $N-1^{th}$ wheelbase values are segmented as one carriage.

$N=N+(\text{axle number of one carriage})$: As the preceding wheelbase values have all been used for segmentation, the next segmentation starts from the $N+(\text{axle number of one carriage})^{th}$ axle. $i=i-(\text{axle number of one carriage})$, namely the number of wheelbases that are not used for segmentation is reduced by the number of axles of one carriage; $T=N$, namely the preceding $(N+\text{axle number of one carriage}-1)$ wheelbases have all been segmented, and there are no more wheelbase values that have not been used for segmentation.

EXAMPLES

When a train illustrated by FIG. 7 passes a group of sensors of the system of the present invention, altogether there are 14 wheels to produce 13 wheelbase values in turn. As an example, the wheelbase values detected by the collecting card to which the sensors correspond are 1802, 1803, 8378, 1796, 1792, 4233, 1762, 7538, 1753, 2895, 1756, 7530, 1769 in millimeter. When reading 3rd wheelbase value, the four-axle law is applied to the $1^{st}$ to $3^{rd}$ wheelbase values, and obviously these three wheelbase values do not satisfy the laws in the four-axle law which the preceding three axles should satisfy. And when the 6th wheelbase value is read, the six-axle law is applied and found to be satisfied, i.e., $1802 \approx 1792$, $1803 \approx 1796$, $1802+1803+8378+1796+1792>7000$ and $8378>4233>1802$. Therefore, 1802, 1803, 8378, 1796, 1792 and 4233 can be segmented as one carriage. Then analysis starts from the $7^{th}$ wheelbase "1762", and obviously the four axles $7^{th}$ to $10^{th}$ satisfy the four-axle law and thus can be segmented as one carriage. The remaining wheelbases are then segmented as the last carriage.

When a train passes, the signal of an axle might be lost due to various possible reasons, such as vibration of the train. For example, as shown in FIG. 7, when a train comprising three carriages passes a group of sensors, the signal of the fifth axle is lost, and altogether there are 14 wheels producing 12 wheelbase values in turn. As an example, the wheelbase values detected by the collecting card to which the sensors correspond are 1802, 1803, 8378, 3588, 4233, 1762, 7538, 1753, 2895, 1756, 7530 and 1769 in millimeter (i.e. totally 12 wheelbase values, in which the original $4^{th}$ and $5^{th}$ wheelbase values are combined into one wheelbase value). Analysis is performed starting from the first wheelbase "1802", and when applying the four-, five-, six- and eight-axle laws, it is found that none of them is satisfied. Therefore, put the first wheelbase value aside, and analysis is performed starting from the second wheelbase value "1803", and again it is found that none of said laws is met. Then analysis is performed starting from the third wheelbase value, . . . and so on. When analysis is performed starting from the $6^{th}$ wheelbase "1762", it is found that the $6^{th}$-$9^{th}$ wheelbase values satisfy the four-axle law, so they can be segmented as one carriage, and the previously $1^{st}$ to $5^{th}$ wheelbases are segmented as one carriage and the remaining as the last carriage.

(3) Determination of Train Type

Figure 9:
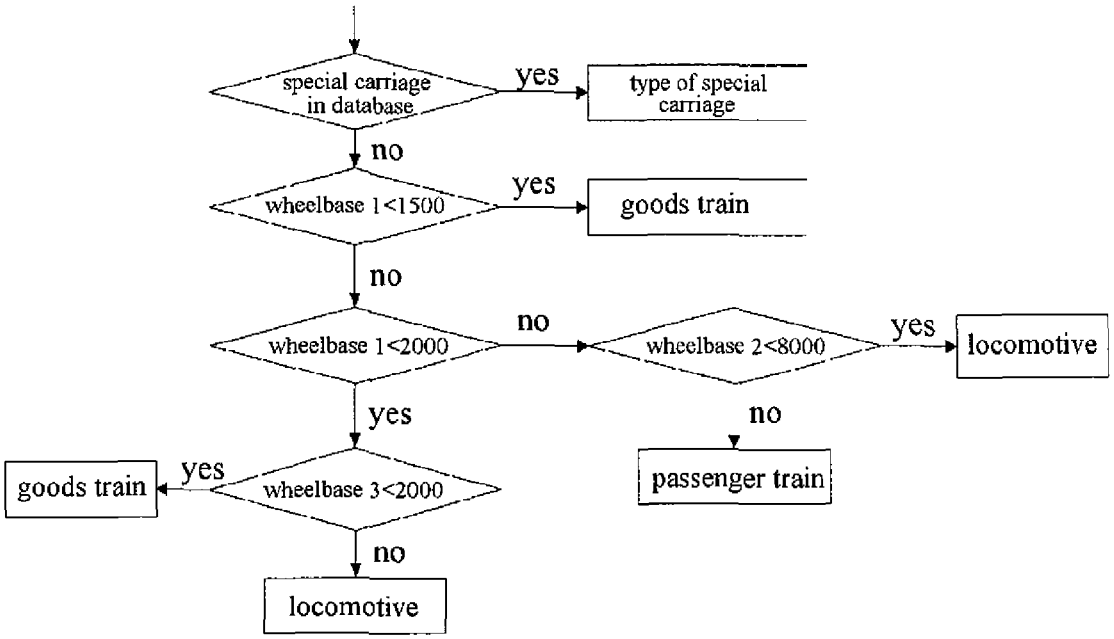
FIG. 9 is an illustrative flow diagram showing the determination of the carriage type by the system of the present invention.

FIG. 9 is a flow diagram showing the determination of carriage type.

The determination of the type of an up train makes use of the wheelbase value calculated by the PCI board card to which the sensors group S1 (X1, for a down train) corresponds.

Because passenger carriages are not mixed with goods carriages in the equipment using field in China, a goods train can be defined as: the train has a locomotive at the head thereof, and all the carriages following the locomotive are goods carriages. Therefore, the determination of the type of a whole train is based on the determination of each carriage. The system uses the following three laws to determine the segmentation of a train. The first law is that, the wheels and axles of most carriages are symmetric about the central lines thereof. The second law is the distance from the first wheel to the last wheel of one carriage is greater than 7,000 mm. The third law is that the wheelbase between two bogies is greater than the wheelbase at the hook and the wheelbase at the hook is greater than the wheelbase of the bogie. First of all, a train is segmented as individual carriages by using the wheelbases obtained by the system. Then the type of each carriage is determined based on its wheelbases. Because the number of axle of one carriage in China is more than four, while the wheelbases between the first three axles of a locomotive, a passenger carriage and a goods carriage differ obviously, so the type of a single carriage can be determined based on the wheelbases between the first three axles thereof. If two successive carriages following one locomotive are found to be goods carriages, the whole train is a goods train. But if one of the two carriages is a passenger carriage, the whole train is determined to be a passenger train.

By analyzing the wheelbase data of the train wheels running currently in China, the following laws can be obtained: if the first wheelbase of a carriage is less than 1,500 mm, the carriage is a goods carriage; if the first wheelbase and the third wheelbase of a carriage are both less than 2,000 mm, the carriage is a goods carriage; if the first wheelbase is greater than or equal to 2,000 mm and the third wheelbase of a carriage is greater than 2,000 mm, it is a locomotive; if the first wheelbase is greater than or equal to 2,000 mm but the second wheelbase of a carriage is less than 8,000 mm, it is a locomotive; if the first wheelbase is greater than or equal to 2,000 mm but the second wheelbase of a carriage is greater than or equal to 8,000 mm, it is a passenger carriage.

Therefore, according to the above laws, the system of the present invention can correctly analyze and determine the type of a train, i.e. a locomotive, a goods train or a passenger train on the basis of the wheelbase data of the train.

Of course, with the development of train types henceforth, there may be train types that do not meet the above laws, so the system uses database technology. For example, a database is installed in the industrial personal computer 4 in the system of the present invention. Wheelbase information of certain train types can be input in the database in advance. The type of a train is determined by searching in the database, and if the wheelbase information of the train is consistent with that in the database, the train can be determined to be the type defined in the database; if not, analysis is conducted according to said laws.

After the train type is determined, the 2nd bit and the 3rd bit in the second byte of the serial-port information packet are set to be corresponding values. And for a goods train, the 3rd bit in the third byte to is set to be 0, and sent to PLC via the serial port.

(4) Train Hook Locating

A train inspection system needs to acquire the image of every carriage, so it needs to determine the exact time when the hook portion (namely the connection portion of two carriages) arriving at the beam flux center (namely the X-ray source O in FIG. 2). Besides, in order to take accurate photos of the head, body and tail of a train, the photograph system also needs to determine when a hook portion arriving at the camera center. The sensor group S2 is adopted for said determination at the up X-ray system, while the sensor group S3 is adopted for said determination at the up photograph system. The sensor group X3 is adopted for said determination at the down X-ray system, and the sensor group X2 is adopted for said determination at the down photograph system.

Therefore, a train inspection system requires the system of the present invention to provide the exact time when the hook center (namely the point Q in FIG. 10) between each goods carriage and its previous one arriving at the X system (namely X-ray source), so that the train inspection system can obtain the image of said goods carriage. In fact, the system of the present invention sends a hook locating prediction signal to the train inspection system properly a period of time before each hook center (point Q) of the train arrives at the X system. Likewise, the system of the present invention also sends a hook locating prediction signal to the train inspection system properly a period of time before each hook center (point Q) of the train arrives at the camera center. In practice, the system of the present invention adopts the following technical solutions (namely the "hook locating" in the present invention) to accomplish the above tasks.

Next, the locating at the up X system is explained as an example. Locating (e.g. locating at the photograph system) at other necessary places is similar. When the wheelbase data acquired by the collecting card to which the sensors of group S2 correspond are used for segmentation, it is found that i=1, namely the second wheel of a carriage is pressing exactly on this group of sensors. Then it can be calculated in accordance with a calculating formula (namely the formula 3 below) that: after a period of time (or referred to as time delay T), the hook center preceding the current carriage is exactly passing the beam flux center of the X-ray inspection system. Therefore, after said time delay T, the hook locating information is immediately provided, namely adding 1 to the number of hooks at the point O in the fourth byte of the serial-port information packet. If it is determined according to the wheelbase detected by S1 that the current carriage is a goods carriage, it is necessary to set the 0th bit of the third byte to be 1, which indicates that scanning begins, and said information is sent to PLC via the serial port.

Figure 10:
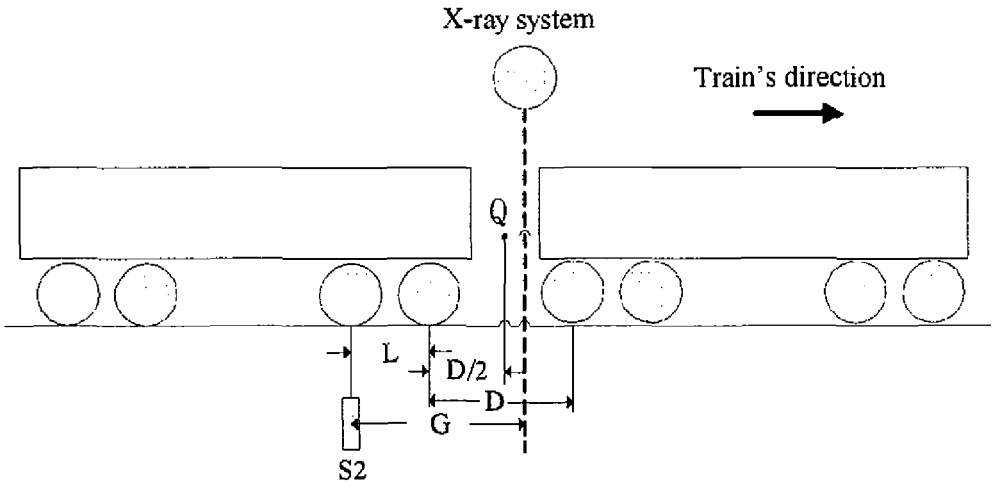
FIG. 10 is a schematic diagram showing the principle of the train hook locating process of the system of the present invention.

As shown in FIG. 10, S2 represents the second group of sensors in the up direction, G represents the distance between the sensor group S2 and the X system beam flux center, and L represents the first wheelbase of a following carriage. If D is used to represent the hook to hook distance between a preceding carriage and the following one (the distance between the last wheel of the preceding carriage and the first wheel of the following carriage), D/2 shown in the figure is just ½ of the hook to hook distance. Q represents the central point of the hook distance. The sensor group S2/X3 is mounted 3,000-4,500 mm away from the X system beam flux center. The first wheelbase (wheelbase of bogie) of each goods carriage is usually less than 1,900 mm, whereas the hook distance is generally no more than 3,400 mm, therefore the default hook center is the central point of the hook distance or referred to as hook center. As a result, when the second wheel of the following carriage runs over the sensors, because G−(D/2)−L is very small, it can be defaulted that the speed V within this distance is constant. The speed calculating formula 1 used previously can be used for calculating when the hook center arrives at the X-ray source O. The moment at which the second wheel of said goods carriage arrives at S2 is T1. The system of the present prescribes that a hook locating prediction signal should be sent out exactly at time T1. In other words, the hook locating prediction signal sent at time T1 should comprise a piece of information that is said time delay T. Said time delay T indicates that: said hook center will arrive at the position of the X-ray source a time delay T later than said time T1, i.e., at time T2 (T2=T1+T). It can be seen from FIG. 10 that, because the specific value of G is known in the present system (for example, it can be seen from FIG. 2 that the distance between S2 and O is d2, and all these data are stored in the database of the present system for retrieval). Besides, the following three quantities, namely the speed V, the first wheelbase L of the second carriage and the wheelbase D between the last axle of the first carriage and the first axle of the first carriage, are already known in the system of the present invention. Therefore, T can be calculated by using the following formula:

$$T = \frac{G - (D/2) - L}{V} \qquad \text{formula 3}$$

(5) The Determination of Train Arrival

The determination of the arrival of an up-running train makes use of the wheelbase values calculated by the PCI board card to which the sensor group S1 (X1 for down-running train) corresponds. Take the up-running train as an example. When system software reads wheelbase data from the FIFO of the PCI data collecting card to which the sensor group S1 corresponds, and segments these wheelbases, the type of a single carriage is determined. If the number of wheelbases being read accumulates to be more than 12 (the first condition), and it is determined that one among the carriages of the train obtained from the segmentation according to said wheelbase information is a locomotive (the second condition), it will be deemed that a train has arrived. The first condition is only to prevent the system from tripping when only a locomotive passes the scanning system, while the second condition 2 to prevent system from tripping when the train to be scanned re-starts after parking on the scanning channel.

After it is determined that a train is coming, the serial-port information packet has its bit 0 of the second byte set to 1, and sent to PLC via the serial port.

(6) The Determination of Train Departure

Because the minimum scanning speed required by a goods train inspection system is 5,000 m/h, so the minimum running speed of the train defined by the system is Vm=5,000 m/h. The maximum wheelbase hm of a carriage is generally no more than 20 meters. From the following simple calculation: the speed of 5,000 m/h is equivalent to 1.388 m/s (5000/3600=1.388), and the maximum wheelbase 20 m/1.388 m/s=14.4 seconds, it can be seen that the extreme time interval Tm between two wheel pulses to which the maximum wheelbase corresponds is 14.4 seconds, namely it is impossible to reach 15 seconds.

(7) The Acquisition of Carriage Number

In the goods train inspection system, it is necessary to correlate the image of a single carriage scanned by the X system, the appearance of the carriage photographed by the photograph system and the number of the carriage to facilitate examination by customs. The number of the carriage is provided by the system of the present invention. Most of the goods carriages that need to be examined by the goods train inspection system are provided with electronic tags, in which carriage number information is included.

The principle of the carriage number reading device in the system of the present invention is based on wireless RF technique. When an electronic tag approaches the effective region of the antenna of the carriage number reading device, the carriage number reading device will acquire a carriage number every other period of time. Therefore, when a whole carriage passes, a plurality of identical carriage number will be produced. And when one carriage passes, the carriage number reading device will acquire a plurality of identical carriage number. When a whole train passes, a plurality of different carriage number will be produced, and these numbers are exactly consistent with the number of carriages provided with electronic tags. As the system might be used on the border, and foreign carriages may not have electronic tags and the electronic tags of some domestic carriages may be lost or damaged, it is necessary to correlate the carriage numbers acquired with specific carriages.

By analysis and in-situ test, a law is obtained: when a segment of train passes, the tag it corresponds to appears most frequently. Therefore, when reading carriage number, it is necessary to record which carriage is currently passing the system, and analyze carriage numbers after the train departs. For example, if 16 pieces of information are read from tag A when a whole train passes, and the tag A is read one time when the $15^{th}$ carriage passes, 14 times when the $16^{th}$ carriage passes, and zero time when the $17^{th}$ carriage passes, then said tag is the tag of the $16^{th}$ carriage. After analysis, the carriage number and corresponding information of the carriage are written into a text file, and sent to the data processing center (DPC) via FTP.

Figure 11:
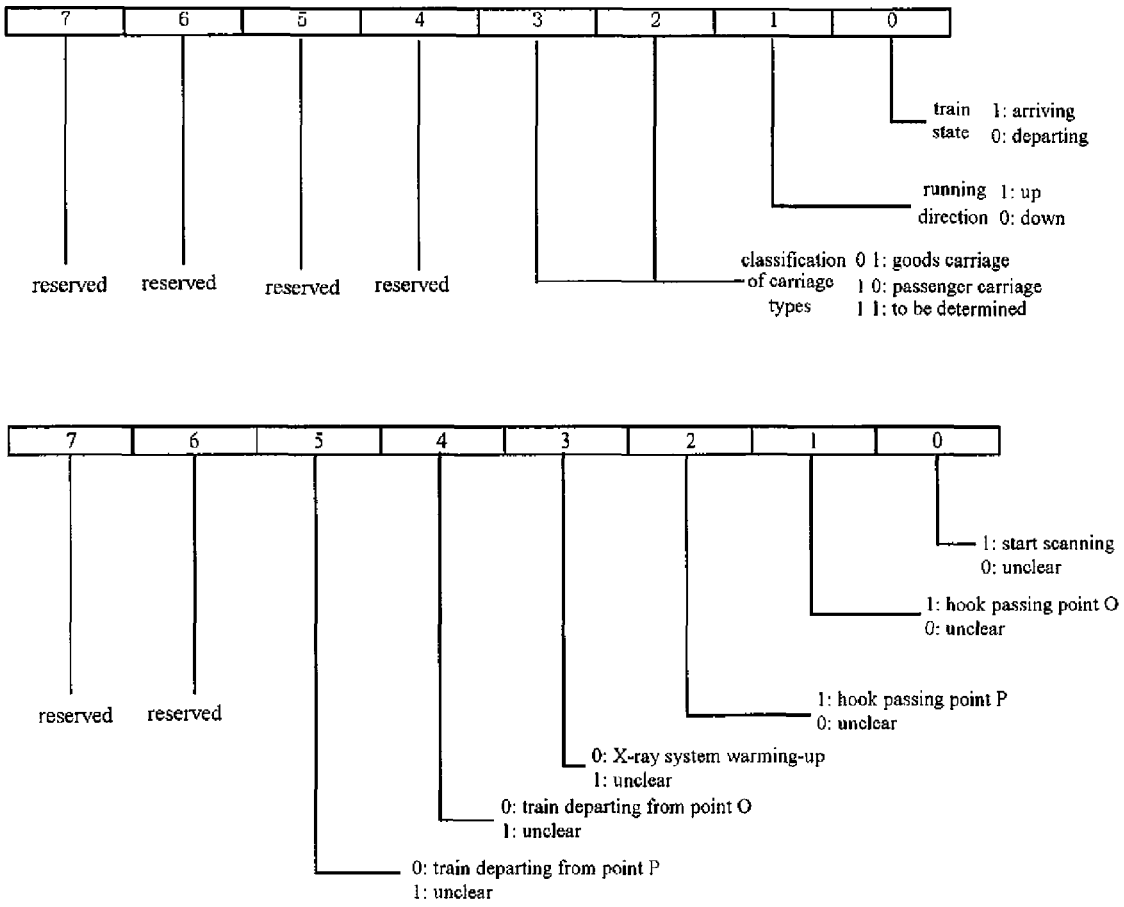
FIG. 11 is a schematic diagram of the serial-port data output by the system of the present invention.

FIG. 11 schematically explains the serial port information sent to PLC of the train inspection system via a serial port by the train identification system of the present invention. The serial port information sent to PLC is composed of data packet of 9 bytes in total, wherein the first byte is header (0xE7), the $2^{nd}$-$7^{th}$ bytes are data contents, the $8^{th}$ byte is total check sum of data contents, and the last byte is end (0xEF). As an example, the upper portion of FIG. 11 schematically gives the meanings of the respective bits of the $2^{nd}$ byte, the lower portion of FIG. 11 schematically gives the meaning of the respective bits of the $3^{rd}$ byte. The $4^{th}$ byte indicates the number of hooks of the current train that pass point O, and the $5^{th}$ byte indicates the number of hooks of the current train that pass point P. The $6^{th}$ and $7^{th}$ bytes indicate the speed of the train. In FIG. 11, the meanings of the respective bits have been explained, in which "reserved" means that this bit does not function and is reserved for future expansion; "to be determined" means that the type of train is not determined and waiting for judgment, and "unclear" means that this bit has not been determined.

The invention claimed is:

1. A method for providing identification information of a train, comprising:

arranging an array of sensors along one rail, the array comprising a first, a second and a third up sensor groups (S1, S2, S3) arranged in an order and a first, a second and a third down sensor groups (X1, X2, X3) arranged in an opposite order, wherein each of said groups comprise at least two sensors;

calculating the speed and wheelbases of the train by using signal from the first up/down sensor group (S1/X1), and segmenting the calculated wheelbases by using known segmenting flow in a system database;

the method provides one of a first, a second and a third information, wherein determining the types of the respective carriages corresponding to the segmented wheelbases by using known carriage type distinguishing flow in the system database, and if a locomotive is distinguished and the number of wheelbases read continuously exceeds the maximum number of wheelbases of an known locomotive, it is determined that a train arrives, thereby providing the first information on the arrival of a train;

monitoring the time intervals between the signal pulses of wheels provided by respective sensor groups, if the finish time of the signal pulses of any one sensor group has exceeded the extreme time interval (Tm) determined by the maximum carriage wheelbase (hm) and a defined minimum train speed (Vm), it is determined that the signal of said sensor group has stopped, and if the signals of all sensor groups stop, it is determined that the train has departed and the second information on the train's departure will be provided; and determining the types of the carriages corresponding to the segmented wheelbase data by using known carriage type distinguishing flow in the system database and thereby providing the third information of the types of carriages.

2. The method according to claim 1, wherein the minimum values of the spacing (d1) between the first up sensor group (S1) and X-ray source (O) and the spacing (d7) between the first down sensor group (X1) and X-ray source (O) are determined by the maximum train speed as well as the time for beam flux stabilizing required before the X-ray source (O) of a train inspection system, which is arranged on one side of the rail, starts to scan.

3. The method according to claim 2, wherein the spacing (d1) between the first up sensor group (S1) and X-ray source (O) and the spacing (d7) between the first down sensor group (X1) and X-ray source (O) are in the range of 3,000-700,000 mm.

4. The method according to claim 1, wherein the value of the spacing (d4) between the photograph system (P) and X-ray source (O) is determined by the actual spacing (d1) between the first up sensor group (S1) and X-ray source (O) as well as the actual spacing (d7) between the first down sensor group (X1) and X-ray source (O), wherein P can be arranged in any place between S1 and X1.

5. The method according to claim 1, wherein the minimum values of the spacing (d2/d5) between the second/third up sensor group (S2/S3) and X-ray source (O)/photograph system (P), as well as the spacing (d3/d6) between the third/second down sensor group (X3/X2) and X-ray source (O)/photograph system (P) are determined by the distance from the second axle of a goods carriage to its closest hook center.

6. The method according to claim 5 wherein the spacing (d2/d5) between the second/third up sensor group (S2/S3) and X-ray source (O)/photograph system (P), as well as the spacing (d3/d6) between the third/second down sensor group (X3/X2) and X-ray source (O)/photograph system (P) are in the range of 3,000-4,500 mm.

7. The method according to claim 1, wherein when providing one of the first and second information the segmenting flow in the system database comprises:

a) extracting a sequence of the calculated wheelbase data of a train;

b) sequentially reading from said sequence a group of wheelbases to be segmented that correspond to the minimum number in the range of axle number of a single segment of train known in the system database, to form a first group of wheelbases;

c) checking if said first group of wheelbases meet the known train segmenting law in the system database;

d) dividing a segment of train according to said group of wheelbases if said law is met;

e) otherwise, sequentially reading a group of wheelbases to be segmented that correspond to an incremental second number, to form a second group of wheelbases, and repeating the checking operation of the above step c);

f) repeating the above steps until the group of wheelbases that corresponds to the maximum number is used to carry out the checking operation, and pausing as long as one checking operation therein meets the law, then segmenting one segment of train according to the group of wheelbases used in said checking operation.

8. The method according to claim 1, wherein the extreme time interval Tm is 14.4 seconds.

9. The method according to claim 1, wherein when providing the third information the segmenting flow in the system database comprises:

a) extracting a sequence of the calculated wheelbases of a train;

b) sequentially reading from said sequence a group of wheelbases to be segmented that correspond to the minimum number in the range of axle number of a single segment of train known in the system database, to form a first group of wheelbases;

c) checking if said first group of wheelbases meet the known train segmenting law in the system database;

d) dividing a segment of train according to said group of wheelbases if said law is met;

e) otherwise, sequentially reading a group of wheelbases to be segmented that correspond to an incremental second number, to form a second group of wheelbases, and repeating the checking operation of the above step c);

f) repeating the above steps until the group of wheelbases that correspond to the maximum number is used to carry out the checking operation, and pausing as long as one checking operation therein meets the law, then segmenting one segment of train according to the group of wheelbases used in said checking operation;

g) returning to the starting point of step b), continuing reading new wheelbase data to be segmented from said sequence, repeating steps b)-f) to segment a second carriage, and repeating these steps until all wheelbase data in the sequence have been read, thereby completing the segmenting of all carriages of the entire train.

10. The method according to claim 9, wherein if there is such situation as unsuccessful segmentation after using the maximum number of wheelbases in a certain round in said step f) due to occasional loss, then the step b) in the segmenting flow is altered to:

discarding the first wheelbase in the first group of wheelbases with the minimum number in said round, and supplementing a new wheelbase to be segmented, thereby forming the first group of wheelbases of a new round to repeat step b);

executing steps c)-f);

if the segmentation is still unsuccessful when the step f) has executed in this round, the first wheelbase in the new first group of wheelbases is discarded, and a next new wheelbase to be segmented is supplemented, thereby forming a newer round of first group of wheelbases to re-execute the steps b)-f);

repeating the above steps until one segment of train is successfully segmented, then returning to segment all discarded wheelbases as one segment of train.

11. The method according to claim 1, wherein the known train type distinguishing flow comprises:

i) forming a group of wheelbases from the segmented wheelbases that appear first, and when said group of wheelbases are equal to the wheelbases of a special carriage in the database, it is determined that said group of wheelbases corresponds to a special carriage type;

ii) if the first wheelbase of the said group <1,500 mm, a goods carriage is determined;

iii) if in said group of wheelbases, the first wheelbase <2,000 mm, and the third wheelbase <2,000 mm, a goods carriage is determined, otherwise a locomotive is determined;

iv) when the first acquired wheelbase <2,000 mm and the third wheelbase ≧2,000 mm, a locomotive is determined;

v) when the first acquired wheelbase ≧2,000 mm and the second wheelbase <8,000 mm, a locomotive is determined;

vi) when the first acquired wheelbase ≧2,000 mm and the second wheelbase ≧8,000 mm, a passenger carriage is determined;

vii) when two successive carriages following one locomotive are both goods carriages, the whole train is determined to be a goods train; and if one of the two carriages is a passenger carriage, the whole train is determined to be a passenger train.

12. A method of providing identification information of a train, comprising:

arranging an array of sensors along one rail, the array comprising a first, a second and a third up sensor groups (S1, S2, S3) arranged in an order and a first, a second and a third down sensor groups (X1, X2, X3) arranged in an opposite order, wherein each of said groups comprise at least two sensors;

using a signal from the second up/third down sensor group (S2/X3) to calculate the speed and wheelbases of a train, and using known segmenting flow in a system database to segment the calculated wheelbases;

the method provides one of a first, a second and a third information, wherein in the case of a goods train, reading the time (T1) at which the second wheel of the second carriage of two successive carriages that have been segmented arrives at the position of the second up/third down sensor group (S2/X3), thereby providing the first information that is hook locating information comprising a given amount of delay (T) for use by an X-ray system;

in the case of a passenger/goods train, reading the time (T1') at which the second wheel of the second carriage of two successive carriages that have been segmented arrives at the position of the third up/second down sensor group (S3/X2), thereby providing the second information that is hook locating information comprising a given amount of delay (T') for use by a photograph system; and reading the carriage numbers from the electronic tags on the segmented carriages successively by the up/down carriage number reading device, determining that the electronic tag being read the maximum times belongs to the carriage being run over the carriage number reading device, thereby providing the third information that is the numbering information of the train.

13. The method according to claim 12, wherein the minimum values of the spacing (d1) between the first up sensor group (S1) and X-ray source (O) and the spacing (d7) between the first down sensor group (X1) and X-ray source (O) are determined by the maximum train speed as well as the time for beam flux stabilizing required before the X-ray source (O) of a train inspection system, which is arranged on one side of the rail, starts to scan.

14. The method according to claim 13, wherein the spacing (d1) between the first up sensor group (S1) and X-ray source (O) and the spacing (d7) between the first down sensor group (X1) and X-ray source (O) are in the range of 3,000-700,000 mm.

15. The method according to claim 12, wherein the value of the spacing (d4) between the photograph system (P) and X-ray source (O) is determined by the actual spacing (d1) between the first up sensor group (S1) and X-ray source (O) as well as the actual spacing (d7) of the first down sensor group (X1) and X-ray source (O), wherein P can be arranged in any place between S1 and X1.

16. The method according to claim 12, wherein the minimum values of the spacing (d2/d5) between the second/third up sensor group (S2/S3) and X-ray source (O)/photograph system (P), as well as the spacing (d3/d6) between the third/second down sensor group (X3/X2) and X-ray source (O)/photograph system (P) are determined by the distance from the second axle of a goods carriage to its closest hook center.

17. The method according to claim 16, wherein the spacing (d2/d5) between the second/third up sensor group (S2/S3) and X-ray source (O)/photograph system (P), as well as the spacing (d3/d6) between the third/second down sensor group (X3/X2) and X-ray source (O)/photograph system (P) are in the range of 3,000 -4,500 mm.

18. The method according to claim 12, wherein the segmenting flow in the system database comprises:

a) extracting a sequence of the calculated wheelbases of a train;

b) sequentially reading from said sequence a group of wheelbases to be segmented that correspond to the minimum number in the range of axle number of a single segment of train known in the system database, to form a first group of wheelbases;

c) checking if said first group of wheelbases meet the known train segmenting law in the system database;

d) dividing a segment of train according to said group of wheelbases if said law is met;

e) otherwise, sequentially reading a group of wheelbases to be segmented that correspond to an incremental second number, to form a second group of wheelbases, and repeating the checking operation of the above step c);

f) repeating the above steps until the group of wheelbases that correspond to the maximum number is used to carry out the checking operation, and pausing as long as one checking operation therein meets the law, then segmenting one segment of train according to the group of wheelbases used in said checking operation;

g) returning to the starting point of step b), continuing reading new wheelbases to be segmented from said sequence, repeating steps b)-f) to segment a second carriage, and repeating these steps until all wheelbases in the sequence have been read, thereby completing the segmenting of all carriages of the entire train.

19. The method according to claim 12, wherein the given amount of time delay (T) is calculated in accordance with the following formula:

$$T = \frac{G - (D/2) - L}{V}$$

by reading the spacing (D) between the hooks of two carriages, the first wheelbase (L) of the second carriage, the spacing (G) between the second up/third down sensor group (S2/X3) and the X system as well as the wheel speed (V) at the moment (T1) when the second wheel of the second carriage arriving at the position of said sensor group (S2/X3).

20. The method according to claim 12, wherein the given amount of time delay (T') is calculated in accordance with the following formula:

$$T' = \frac{G' - (D'/2) - L'}{V'}$$

by reading the spacing (D') between the hooks of two carriages, the first wheelbase (L') of the second carriage, the spacing (G') between the third up/second down sensor group (S3/X2) and the X system as well as the wheel speed (V') at the moment (T1') when the second wheel of the second carriage arriving at the position of said sensor group (S3/X2).

21. The method according to claim 12, wherein the up/down carriage number reading devices are symmetrically mounted on the up/down sides of the X-ray source (O) respectively, the minimum values of the spacings (dS/d9) there between are determined in such way that interference can be decreased and reading probability can be increased.

22. The method according to claim 21, wherein the spacing (d8/d9) between the up/down carriage number reading device and X-ray source (O) is in the range of 100-5,500 mm.

23. A method of providing identification information of a train, comprising:

i) arranging an array of sensors along one rail, the array comprising a first, a second and a third up sensor groups (S1, S2, S3) arranged in an order and a first, a second and a third down sensor groups (X1, X2, X3) arranged in an opposite order, wherein each of said groups comprise at least two sensors;

ii) in the signal from the first up/down sensor group (S1/X1), if the signal from former appears first, then it can be determined that there is a up train, otherwise there is a down train, and the signal from the first up/down sensor group (S1/X1) is used to calculate the speed and wheelbases of the train, and a known segmenting flow in a system database is used to segment the wheelbases;

iii) using known type distinguishing flow in the database to determine the type of carriages corresponding to the segmented wheelbases, and if one carriage is determined to be locomotive and the number of wheelbases that are read successively exceeds the maximum number of wheelbases of a known locomotive, it is determined that an up/down-running train arrives, thereby providing first information on the arrival of an up/down-running train;

iv) successively determining the types of the two carriages behind said locomotive, and if at least one of them is a passenger carriage, it is determined that the train is a passenger train, otherwise a goods train, thereby providing second information on the arrived train being a passenger/goods train;

v) for a goods train, reading the time point (T1) at which the second wheel of the second one of two successive carriages arrives at the position of the second up/third down sensor groups (S2/X3), thereby providing third information on the train hook locating information that comprises a given amount of time delay (T) and is for use by a X-ray source;

vi) reading the carriage numbers from the electronic tags on the segmented carriages successively by the up/down carriage number reading device, and determining that the electronic tag being read the maximum times belongs to the carriage being running over the carriage number reading device, thereby providing fourth information on the number of each carriage;

vii) for a passenger/goods train, reading the time point (T1') at which the second wheel of the second one of two segmented carriages arrives at the position of the second up/third down sensor groups (S3/X2), thereby providing fifth information on vehicle hook locating that comprises a given amount of time delay (T') and is for use by a photograph system;

viii) monitoring the time intervals between the pulses of respective wheels from respective sensor groups, and if the finish time of the signal pulse from any one sensor group has exceeded the extreme time interval (Tm) determined by the maximum wheelbase (hm) of a carriage and a defined minimum speed of the train (Vm), it is determined that the signal from said sensor group has stopped, and if signals from all sensor groups stop, a sixth information on the train's departure will be provided.

24. The method according to claim 23, wherein: the minimum values of the spacing (d1) between the first up sensor group (S1) and X-ray source (O) and the spacing (d7) between the first down sensor group (X1) and X-ray source (O) are determined by the maximum train speed as well as the time for beam flux stabilizing required before the X-ray source (O) of a train inspection system, which is arranged on one side of the rail, starts to scan.

25. The method according to claim 24, wherein the spacing (d1) between the first up sensor group (S1) and X-ray source (O) and the spacing (d7) between the first down sensor group (X1) and X-ray source (O) are in the range of 3,000-700,000 mm.

26. The method according to claim 23, wherein the value of the spacing (d4) between the photograph system (P) and X-ray source (O) is determined by the actual spacing (d1) between the first up sensor group (S1) and X-ray source (O) as well as the actual spacing (d7) between the first down sensor group (X1) and X-ray source (O), wherein P can be arranged in any place between S1 and X1.

27. The method according to claim 23, wherein the minimum values of the spacing (d2/d5) between the second/third up sensor group (S2/S3) and X-ray source (O)/photograph system (P), as well as the spacing (d3/d6) between the third/second down sensor group (X3/X2) and X-ray source (O)/photograph system (P) are determined by the distance from the second axle of a goods carriage to its closest hook center.

28. The method according to claim 27, wherein the spacing (d2/d5) between the second/third up sensor group (S2/S3) and X-ray source (O)/photograph system (P), as well as the spacing (d3/d6) between the third/second down sensor group (X3/X2) and X-ray source (O)/photograph system (P) are in the range of 3,000-4,500 mm.

29. The method according to claim 23, wherein the up/down carriage number reading devices are symmetrically mounted on the up/down sides of the X-ray source (O) respectively, the minimum values of the spacings (d8/d9) therebetween are determined in such way that interference can be decreased and reading probability can be increased.

30. The method according to claim 29, wherein the spacing between the up/down carriage number reading device and X-ray source (O) is in the range of 100-5,500 mm.

31. The method according to claim 23, wherein the segmenting flow in the system database in said step iii) comprises:

a) extracting a sequence of the calculated wheelbases of a train;

b) sequentially reading from said sequence a group of wheelbases to be segmented that correspond to the minimum number in the range of axle number of a single segment of train known in the system database, to form a first group of wheelbases;

c) checking if said first group of wheelbases meet the known train segmenting law in the system database;

d) dividing a segment of train according to said group of wheelbases if said law is met;

e) otherwise, sequentially reading a group of wheelbases to be segmented that correspond to an incremental second number, to form a second group of wheelbases, and repeating the checking operation of the above step c);

f) repeating the above steps until the group of wheelbases that correspond to the maximum number is used to carry out the checking operation, and pausing as long as one checking operation therein meets the law, then segmenting one segment of train according to the group of wheelbases used in said checking operation;

g) returning to the starting point of step b), continuing reading new wheelbases to be segmented from said sequence, repeating steps b)-f) to segment a second carriage, and repeating these steps until all wheelbases in the sequence have been read, thereby completing the segmenting of all carriages of the entire train.

32. The method according to claim 31, wherein, if there is such situation as unsuccessful segmentation after using the maximum number of wheelbases in a certain round in said step f) due to occasional loss, then the step b) in the segmenting flow is altered to:

discarding the first wheelbase in the first group of wheelbases with the minimum number in said round, and supplementing a new wheelbase to be segmented, thereby forming the first group of wheelbases of a new round to repeat step b);

executing steps c)-f);

if the segmentation is still unsuccessful when the step f) has executed in this round, the first wheelbase in the new first group of wheelbases is discarded, and a next new wheelbase to be segmented is supplemented, thereby forming a newer round of first group of wheelbases to re-execute the steps b)-f);

repeating the above steps until one segment of train is successfully segmented, then returning to segment all discarded wheelbases as one segment of train.

33. The method according to claim 23, wherein, the known train type distinguishing flow in said step iii) comprises:

viii) forming a group of wheelbases from the segmented wheelbases that appear first, and when said group of wheelbases are equal to the wheelbases of a special carriage in the database, a special carriage type is determined;

ix) if the first wheelbase of said group <1,500 mm , a goods carriage is determined;

x) if in said group of wheelbases, the first wheelbase <2,000 mm, and the third wheelbase <2,000 mm, a goods carriage is determined, otherwise a locomotive is determined;

xi) when the first acquired wheelbase <2,000 mm and the third wheelbase ≧2,000 mm, a locomotive is determined;

xii) when the first acquired wheelbase ≧2,000 mm and the second wheelbase <8,000 mm, a locomotive is determined;

xiii) when the first acquired wheelbase ≧2,000 mm and the second wheelbase ≧8,000 mm, a passenger carriage is determined;

xiv) when two successive carriages following one locomotive are both goods carriages, the whole train is determined to be a goods train; and if one of the two carriages is a passenger carriage, the whole train is determined to be a passenger train.

34. The method according to claim 23, wherein the given amount of time delay (T) in said step v) is calculated in accordance with the following formula:

$$T = \frac{G - (D/2) - L}{V}$$

by reading the spacing (D) between the hooks of two carriages, the first wheelbase (L) of the second carriage, the spacing (G) between the second up/third down group of sensors (S2/X3) and the X system as well as the wheel speed (V) at the moment (T1) when the second wheel of the second carriage arriving at the position of said sensor group (S2/X3).

35. The method according to claim 23, wherein the given amount of time delay (T') in said step iiv) is calculated in accordance with the following formula:

$$T' = \frac{G' - (D'/2) - L'}{V'}$$

by reading the spacing (D') between the hooks of two carriages, the first wheelbase (L') of the second carriage, the spacing (G') between the third up/second down group of sensors (S3/X2) and the X system as well as the wheel speed (V') at the moment (T1') when the second wheel of the second carriage arriving at the position of said sensor group (S3/X2).

36. The method according to claim 23, wherein the extreme time interval (Tm) in said step viii) is 14.4 seconds.

37. A system for automatically identifying information of a train, comprising:

a sensor array arranged along the rail, comprising three up sensor groups (S1, S2, S3) arranged in an order and three down sensor groups (X1, X2, X3) arranged in an opposite order, each of said groups comprise at least two sensors;

a signal conditioning circuit box connected to the sensor array, comprising mean for processing the signals from sensors into a sequence of regular pulse signal;

a data collecting card connected to the signal conditioning circuit box, comprising mean for calculating the speed and wheelbases of a train from the signals of the sensors;

a carriage number reading device, comprising up and down carriage number reading mean mounted between rails for reading information from the electronic tags on carriages of a train;

an industrial personal computer connected to the data collecting card and carriage number reading device, comprising means for executing steps of:

i) in the signal from a first up/down sensor group (S1/X1), if the signal from former appears first, then it can be determined that there is a up train, otherwise there is a down train, and the signal from the first up/down sensor group (S1/X1) is used to calculate the speed and wheelbases of the train, and a known segmenting flow in a system database is used to segment the wheelbases;

i) using known type distinguishing flow in the database to determine the type of carriages corresponding to the segmented wheelbases, and if one carriage is determined to be locomotive and the number of wheelbases that are read successively exceeds the maximum number of wheelbases of a known locomotive, it is determined that an up/down-running train arrives, thereby providing first information on the arrival of an up/down-running train;

ii) successively determining the types of the two carriages behind said locomotive, and if at least one of them is a passenger carriage, it is determined that the train is a passenger train, otherwise a goods train, thereby providing second information on the arrived train being a passenger/goods train;

iv) for a goods train, reading the time point (T1) at which the second wheel of the second one of two successive carriages arrives at the position of the second up/third down sensor groups (S2/X3), thereby providing third information on the train hook locating information that comprises a given amount of time delay (T) and is for use by a X-ray source;

v) reading the carriage numbers from the electronic tags on the segmented carriages successively by the up/down carriage number reading device, and determining that the electronic tag being read the maximum times belongs to the carriage being running over the carriage number reading device, thereby providing fourth information on the number of each carriage;

vi) for a passenger/goods train, reading the time point (T1') at which the second wheel of the second one of two segmented carriages arrives at the position of the second up/third down sensor groups (S3/X2), thereby providing fifth information on vehicle hook locating that comprises a given amount of time delay (T') and is for use by a photograph system as to process the speed, wheelbases and information from the electronic tags, thereby obtaining train information including an up/down-running train arrival, whether a passenger train or a goods train arrives, locomotive hook locating, carriage number and train departure.

38. The method according to claim 37, wherein the minimum values of the spacing (d1) between the first up sensor group (S1) and X-ray source (O) and the spacing (d7) between the first down sensor group (X1) and X-ray source (O) are determined by the maximum speed of a train as well as the time for beam flux stabilizing required before the X-ray source (O) of a train inspection system, which is arranged on one side of the rail, starts to scan.

39. The method according to claim 38, wherein the spacing (d1) between the first up sensor group (S1) and X-ray source (O) and the spacing (d7) between the first down sensor group (X1) and X-ray source (O) are in the range of 3,000-700,000 mm.

40. The method according to claim 37, wherein the value of the spacing (d4) between the photograph system (P) and X-ray source (O) is determined by the actual spacing (d1) between the first up sensor group (S1) and X-ray source (O) as well as the actual spacing (d7) between the first down sensor group (X1) and X-ray source (O), wherein P can be arranged in any place between Si and X1.

41. The method according to claim 37, wherein the minimum values of the spacing (d2/d5) between the second/third up sensor group (S2/S3) and X-ray source (O)/photograph system (P), as well as the spacing (d3/d6) between the third/second down sensor group (X3/X2) and X-ray source (O)/photograph system (P) are determined by the distance from the second axle of a goods carriage to its closest hook center.

42. The method according to claim 41, wherein the spacing (d2/d5) between the second/third up sensor group (S2/S3) and X-ray source (O)/photograph system (P), as well as the spacing (d3/d6) between the third/second down sensor group (X3/X2) and X-ray source (O)/photograph system (P) are in the range of 3,000-4,500 mm.

43. The method according to claim 37, wherein the up/down carriage number reading devices are symmetrically mounted on the up/down sides of the X-ray source (O) respectively, the minimum values of the spacings (d8/d9) therebetween are determined in such way that interference can be decreased and reading probability can be increased.

44. The method according to claim 43, wherein the spacings (d8/d9) between the up/down carriage number reading device and X-ray source (O) are in the range of 100-5,500 mm.

45. The method according to claim 37, wherein means for processing the signals from sensors in said signal conditioning circuit box comprises a shaping diode circuit, a voltage comparator and an optical coupler.

* * * * *